US008783372B2

(12) United States Patent
Fabre et al.

(10) Patent No.: US 8,783,372 B2
(45) Date of Patent: Jul. 22, 2014

(54) FLUID EJECTION DEVICE WITH REINFORCED SEAL

(75) Inventors: Christian Fabre, Tournefeuille (FR); Alain Bignolais, Leguevin (FR)

(73) Assignee: Airbus Operations S.A.S., Toulouse (FR)

( * ) Notice: Subject to any disclaimer, the term of this patent is extended or adjusted under 35 U.S.C. 154(b) by 396 days.

(21) Appl. No.: 12/740,516

(22) PCT Filed: Oct. 29, 2008

(86) PCT No.: PCT/EP2008/064689

§ 371 (c)(1), (2), (4) Date: Apr. 29, 2010

(87) PCT Pub. No.: WO2009/056574

PCT Pub. Date: May 7, 2009

(65) Prior Publication Data

US 2010/0230118 A1 Sep. 16, 2010

(30) Foreign Application Priority Data

Oct. 30, 2007 (FR) ..... 07 58697
Mar. 28, 2008 (FR) ..... 08 01687
Oct. 3, 2008 (FR) ..... 08 05467

(51) Int. Cl.
*A62C 13/62* (2006.01)

(52) U.S. Cl.
USPC ..... 169/9; 169/6; 169/11; 169/71; 169/85

(58) Field of Classification Search
USPC ..... 169/6, 9, 11, 71, 72, 84, 85; 239/73; 222/41–50
See application file for complete search history.

(56) References Cited

U.S. PATENT DOCUMENTS 2,557,957 A * 6/1951 Ferguson ..... 169/73
3,947,006 A * 3/1976 Bauer et al. ..... 267/120
4,129,759 A * 12/1978 Hug ..... 200/83 R
4,889,189 A * 12/1989 Rozniecki ..... 169/73
6,371,213 B1 4/2002 Smith et al.
6,502,828 B1 1/2003 Sasaki (Continued)

FOREIGN PATENT DOCUMENTS

DE 102 24 675 12/2003
EP 0 750 924 1/1997

(Continued)

OTHER PUBLICATIONS

International Search Report issued Jan. 28, 2009 in PCT/EP08/64689 filed Oct. 29, 2008.

(Continued)

*Primary Examiner* — Jason Boeckmann
(74) *Attorney, Agent, or Firm* — Oblon, Spivak, McClelland, Maier & Neustadt, L.L.P.

(57) ABSTRACT

A compact device for ejecting a fluid including two chambers separated by a separating element of piston type. One of the chambers contains the fluid intended to be ejected, the other chamber is a pressurization chamber, the pressurization of which can cause translational movement of the separating element and ejection of the fluid. The pressurization chamber includes a thimble capable of sealably separating the inside of the pressurization chamber from the side walls of the reservoir. Thus, a seal between two chambers is perfect and durable without degrading slidability of the piston.

13 Claims, 15 Drawing Sheets

(56) References Cited

U.S. PATENT DOCUMENTS

| | | | | |
|---|---|---|---|---|
| 7,239,380 | B2 | 7/2007 | Wild et al. | |
| 2005/0150663 | A1 | 7/2005 | Fabre et al. | |
| 2005/0173132 | A1 * | 8/2005 | Sjostrom | 169/73 |
| 2009/0159300 | A1 | 6/2009 | Fabre | |

FOREIGN PATENT DOCUMENTS

| | | |
|---|---|---|
| EP | 0 784 998 | 7/1997 |
| EP | 1 502 859 | 2/2005 |
| EP | 1 552 859 | 7/2005 |
| EP | 1 819 403 | 8/2007 |
| WO | 93 25950 | 12/1993 |
| WO | 03 037441 | 5/2003 |
| WO | 03 068320 | 8/2003 |

OTHER PUBLICATIONS

French Search Report issued Jun. 10, 2008 in French Patent Application 0758697 filed Oct. 30, 2007.

* cited by examiner

FLUID EJECTION DEVICE WITH REINFORCED SEAL

TECHNICAL FIELD

The present invention relates to a fluid ejection device, in particular to an extinguisher or an emergency hydraulic generator used in an aircraft.

STATE OF THE PRIOR ART

As regards the use of fluid ejection devices as an extinguisher, it is known that extinguishers with a reservoir of extinguishing agent are classified in two large categories. The first category relates to permanently pressurized apparatuses in which a gas ensures permanent pressurization of the extinguishing agent within a single bottle used as a reservoir for it; the extinguishing agent is released through a valve at the outlet of said bottle. In the second category, a propellant gas is only released upon putting the extinguisher to use and releases the extinguishing agent which is therefore not stored under pressure.

As an illustration of an extinguisher of the first type, extinguishers presently used for putting out an aircraft engine fire may be considered. These devices, not only allow the fire to be put out, but also prevent any extension of said fire. The extinguishing agent is contained in a bottle, most of the time with a spherical shape, pressurized by an inert gas; one or more distribution ducts, connected to said bottle, allow distribution of the agent towards the areas to be protected. At the lower end of the bottle, a calibrated cap allows each distribution duct to be blocked. A pressure sensor is also installed in order to continuously check the pressurization of the bottle. When a fire is detected, a pyrotechnic detonator is triggered. The resulting shock wave allows the blocking cap to be pierced, which causes emptying of the bottle and discharge of the extinguishing agent under the effect of the pressure contained in the bottle towards the areas to be protected, via the ducts.

A significant drawback of this type of pressurized extinguishers is their sensitivity to microleaks, which submits them to severe monitoring, inspection and maintenance conditions. Moreover, the extinguishing agent does not completely fill the bottle since the latter should be able to contain the pressurization gas.

As regards the extinguishers of the second category, they use a separate pressurization device. These fire fighting devices are generally equipped with a first reservoir of compressed gas and with a second reservoir for the extinguishing agent. When the device is used, the compressed gas contained in the first reservoir is put into communication via an orifice with the second reservoir of extinguishing agent for the pressurization of the bottle containing the extinguishing agent. When the extinguishing agent is pressurized, it is ejected for fighting the fire, like for the devices of the first extinguisher category.

In certain cases, for extinguishers of the second category, the first reservoir of compressed gas may be replaced by a gas generator, as described in document EP1552859.

This type of extinguisher may comprise a separation means, for example a membrane or a piston, placed in the reservoir so as to define a first enclosure called a pressurization chamber, and a second enclosure containing the extinguishing agent. The purpose of this separation means is to limit heat transfers between the generated gas and the extinguishing agent, as described in document EP1819403 filed in the name of the applicant. Indeed, in the absence of thermal insulation, the extinguishing agent may rapidly absorb the calories of the generated gas and thereby reduce the efficiency for ejecting the extinguishing agent.

However, the performances of such extinguishers may further be optimized. Indeed, an extinguisher used in an aircraft should remain operational over a wide temperature range, notably from about −55° C. because of the high altitude at which the airplane flies, to about +95° C. Depending on the temperature, the extinguishing agent may be subject to large volume variations. These volume variations may induce overpressure in the pressurization chamber, which has several major drawbacks.

Indeed, the constraints as regards safety imposed by international regulations in the aeronautical field make the implementation delicate and complex of devices subject to internal overpressure close to areas which may be supplied with extinguishing agent, in particular in proximity to the engines. Indeed, these devices are likely to be damaged during exterior incidents, for example by ejection of engine parts, by heat or flames. In the same way, explosion of these devices may damage the relevant areas.

In order to meet this regulatory requirement, a solution may consist of producing the extinguisher in a particularly secured way, for example with large wall thicknesses. This solution leads to an increase in the overall mass of the extinguisher, which is a penalty for the performances of the aircraft.

Another solution may consist of moving the extinguisher sufficiently away from the relevant areas. However, moving it away requires the use of a greater distribution duct length between the extinguisher and said areas, which increases the linear pressure loss in the duct and reduces the ejection efficiency. Further, the required significant duct mass is also a penalty.

Of course, the problem remains identical in the case of a use of the fluid ejection device as an emergency hydraulic generator for an aircraft, wherein any overpressure in the ejection device should be avoided in the idle phase while ensuring optimum ejection efficiency.

A fluid ejection device for fire fighting usually comprises, as shown in FIG. 1, a pressurized reservoir A1 connected to a distribution circuit A4 for adduction of the fluid towards the extinction point A5. The reservoir is connected to the distribution circuit A4 via a valve A2 remotely controlled by any suitable device A6. The opening of the valve A2 causes emptying of the pressurized reservoir A1 into the distribution circuit A4 towards the extinction point A5. For maximum efficiency of such a device, it is desirable that the reservoirs be located as close as possible to the extinction point so as to reduce the length of the distribution circuit and to thereby accelerate the transfer of the fluid towards the extinction point while limiting pressure losses.

If a large amount of fluid is required and if it is not possible, taking into account the confinement of the space, to install a large volume reservoir in proximity to the extinction point, or, if for regulatory reasons, having several independent systems or redundancy is imposed, it may be necessary to couple several reservoirs in parallel on the same circuit. In this according to a first embodiment, a first pressurized tank is emptied by opening its connection valve A2 and then the valve is closed and this second pressurized reservoir is emptied by opening its connection valve which is then closed upon ending the emptying and so forth. Closing each valve upon ending the emptying is necessary in order to prevent the fluid ejected from a reservoir, the valve of which has been subsequently opened from filling the previously emptied reservoir(s) instead of being directed towards the extinction point.

This requires a complex control system and valves able to be driven in both directions, opening and closing, i.e. containing mobile parts and subject to sealing defects. The complexity of such a device makes its maintenance costly and reduces its reliability when it is used for safety devices where said device may remain passive for years and should operate perfectly when the time comes.

Thus, the use of a reservoir containing the extinguishing agent at atmospheric pressure is for example known from patent EP1502859B1, or EP1819403. The latter is pressurized either by putting it in communication with a bottle of compressed air or nitrogen, or via a pyrotechnic gas generator directly placed inside the reservoir or nearby and connected to the latter. In the latter case of pressurization of the reservoir, with the membrane separating the fluid from the gases generated by a pyrotechnic reaction of the device according to EP1819403 it is possible to prevent the fluid from absorbing the calories of this reaction and from reducing its efficiency. Such a fluid reservoir is put into direct communication with the distribution circuit, the connection being closed by a tearable cap for a given pressure. This cap plays the role of the valve. Thus, in order to trigger the emptying of the device, it is sufficient to introduce the pressurized gas from the bottle into the reservoir or to trigger the pyrotechnic generator. The differential pressure applied on the cap, the distribution circuit being empty and at atmospheric pressure, while the pressure increases in the reservoir, causes tearing of the latter, thereby allowing the fluid to be poured into the distribution circuit A4 towards the extinction point A5.

This device is more reliable since it does not comprise any moving parts at the valve, parts for which the seal must be ensured and the operation must be guaranteed, notably the absence of jamming, over time.

On the other hand, once the cap is pierced, the latter can no longer ensure closure of the connection of the reservoir with the distribution circuit.

In such situations and wherever the use is provided of valves which are only controllable upon opening, it is possible to insert anti-return valves A3 into the distribution circuit. Such valves only let through the fluid in one direction of flow (direction of the arrow in FIG. 1). During successive triggers of the openings of valves, they thereby prevent other reservoirs connected on the same distribution circuit from being emptied, the fluid from filling the reservoirs emptied earlier. In the case of an installation of a plurality of N reservoirs, at least (N−1) valves A3 have to be installed on the circuit.

So many valves generate pressure losses in the circuit and also have to be subject to regular monitoring in order to ensure their operability. Indeed, as the distribution circuit A4 is empty when the device is not operating, i.e. during times which may attain years, such valves may be subject to jammings caused by condensation which may occur in such circuits, particularly when the device is installed in an aircraft in a non-pressurized area and is therefore subject to temperature and pressure variations over a large amplitude during each flight.

Thus, there exists a need for a device allowing a plurality of fluid reservoirs to be mounted in parallel with view to their sequential triggering without generating excessive pressure losses in the circuit and while preserving operating reliability comparable to that which would be obtained with a single reservoir.

As described earlier, the fluid ejection device according to the prior art comprises a reservoir containing the fluid intended to be ejected, one end of said reservoir including controllable blocking means, such as a valve, capable of putting the fluid in communication with the outside of the reservoir so as to cause its flow.

According to an embodiment, the fluid is thus stored under pressure in the reservoir. The reservoir is connected to a distribution circuit via the valve, the opening of the latter causing ejection of the fluid into the distribution circuit.

According to another embodiment of the prior art, the fluid is not stored under pressure in the reservoir. In order to cause ejection of the fluid, the pressure in the reservoir has to be increased before opening the valve for communication with the distribution circuit. This effect is obtained either by putting the inside of the reservoir directly into communication with a pressurized fluid, for example with compressed air, or by compressing the fluid intended to be ejected via a separating element located inside the reservoir. Such a separating element may be formed by a membrane or by a piston which sealably separates the reservoir into two chambers, one of which containing the fluid intended to be ejected. As the volume of the reservoir is fixed, the pressurization of the fluid to be ejected and its ejection out of the reservoir are accomplished by increasing the volume of the chamber not containing the fluid. Such a volume variation is obtained by moving the separating element either by a purely mechanical device, or by increasing the pressure in the chamber not containing the fluid intended to be ejected. This pressure increase is obtained by injecting into said chamber, called a pressurization chamber, a pressurized fluid.

As both chambers of the reservoir are sealably separated by the separating element, any fluid type may be used without any risk of it not mixing with the fluid intended to be ejected. As an example, this may be compressed air or nitrogen. Advantageously, the fluid injected into the pressurization chamber is generated by a pyrotechnic gas generator, and, according to a particularly advantageous embodiment of the prior art, said pyrotechnic generator is directly located in the reservoir, inside the pressurization chamber.

Finally, the controllable means for blocking the chamber containing the fluid intended to be ejected, may assume the shape of a cap which breaks for a given pressure of said fluid. Under these conditions, a compact device is obtained, including all the means for triggering ejection of the fluid. Such a device is described in European patent application EP1819403 filed in the name of the applicant.

Further, the separating element thermally insulates the pressurization chamber of the fluid intended to be ejected. Thus, when using this device as a fire-fighting device, the fluid to be ejected is for example an extinguishing agent in a liquid phase. This type of fluid may have very high heat capacity and the separating element prevents the pyrotechnic reaction generating the pressurization gas from being slowed down by the absorption of heat by the extinguishing agent.

Among all these embodiments of the prior art, the one which uses a reservoir with a substantially cylindrical shape separated into two chambers by a piston, is the most efficient in terms of ejection of the fluid, i.e. this embodiment maximizes the ratio between the fluid volume actually poured into the distribution circuit and the fluid volume initially contained in the reservoir.

In this type of device, the ejection sequence is carried out in five essential phases:

1. The triggering of the gas generator causes a pressure increase in the pressurization chamber and correlatively, via the piston, in the chamber containing the fluid.

2. Beyond a defined pressure threshold, the cap of the chamber containing the fluid to be ejected breaks, putting said fluid in communication with the distribution circuit.

3. The separating element may then move and push the fluid into the distribution circuit.

4. When the piston arrives at the end of travel, means lock the piston in this position so as to avoid any return of the fluid towards the reservoir.

5. Specific means forming a valve then enable the gases from the pressurization chamber to flow towards the distribution circuit in order to purge said circuit.

The pressure, both in the pressurization chamber and in the chamber containing the fluid to be ejected, is high at the beginning of the triggering and passes through a maximum when the cap breaks. It then decreases in order to attain a value close to atmospheric pressure at the end of the discharge.

Such a device is a single use device.

When it is used as a fire-fighting device or as an emergency device, it may remain inactive for very long periods, which may attain several years and will have to nonetheless operate perfectly when the time comes. Now, as the piston is caused to slide inside the reservoir, it is difficult to ensure a perfect seal between both chambers while preserving easy slidability of the piston and this for periods which may attain several years.

Thus, according to these embodiments of the prior art, small amounts of fluid to be ejected end up infiltrating the pressurization chamber.

If said pressurization chamber is in communication with the outside air, this fluid may evaporate. The thereby evaporated fluid is lost, reducing in proportion the amount of fluid capable of being ejected. If the pressurization chamber is sealed against the outside, then accumulation of this fluid in the latter reduces in proportion the efficiency of the pyrotechnic reaction and subsequently that of the ejection of the fluid.

Moreover, particularly if the pressurization chamber is in communication with the outside, condensation phenomena may occur therein. Water thereby introduced into this chamber may, in the long run, mix with the fluid to be ejected, with the risk of degrading the characteristics of use of the latter.

Finally, even if it remains possible to guarantee the seal of the piston when the device is at rest, the first phase of the ejection remains a critical phase because of the rapid pressure variations which occur during this phase. The seal may also be preserved under these pressure conditions.

There is therefore a need for a compact fluid-ejecting device including two chambers separated by a separating element of the piston type, the seal of which between both chambers is perfect and durable without however degrading the slidability of the piston.

Discussion of the Invention

In order to solve at least in part the insufficiencies of the prior art, the invention proposes a fluid ejection device comprising a reservoir of a substantially cylindrical shape, a separating element dividing it into two chambers, sealing means between the separating element and the side walls of the reservoir, said separating element being slidable in the reservoir along the longitudinal axis of the latter so as to modify the relative volume of the chambers, a first chamber being filled with a fluid and being provided with an orifice closed by a cap so that said fluid may be ejected under pressure from the reservoir through said orifice under the effect of the translational movement of the separating element and of the opening of the cap as well as means capable of modifying the pressure in the chamber not containing any fluid, a so-called pressurization chamber, in order to cause translational movement of the separating element. According to the invention, said pressurization chamber further comprises a thimble capable of sealably separating the inside of the pressurization chamber from the sidewalls of the reservoir.

Thus, possible leaks of fluid to be ejected which may occur between the separating element and the wall of the reservoir remain confined between the wall and the thimble. Therefore there is no risk of losing fluid to be ejected notably by evaporation of the latter in the pressurization chamber, nor is there any risk of mixing condensation products of the pressurization chamber with the ejection fluid.

Advantageously, the thimble is capable of constantly providing the seal between the pressurization chamber and the walls of the cylinder between two longitudinal positions of the separating element. This allows preservation of the seal during movements of the piston notably generated by heat expansion of the fluid to be ejected, as well as during at least one part of the first two phases of the discharge.

Advantageously, said thimble consists of a diametrically expansible flexible material. Thus, in addition to causing translational movement of the piston, the pressure increase in the pressurization chamber causes expansion of the thimble, pressing it against the walls of the reservoir. The thimble therefore continues to provide the seal between both chambers even in the presence of higher pressure. With this effect, the operation of the device may be secured even if the sealing means between the piston and the walls of the reservoir have slightly degraded over time and are no longer capable of providing a perfect seal under pressure, therefore particularly at the beginning of the ejection just before and immediately after the opening of the cap.

As soon as the cap is broken and that flowing has begun, the pressure of the fluid to be ejected is just only dependent on the characteristic and the pressure losses of the distribution circuit. During the second phase of the ejection, the efficiency of the device depends on the capability of the piston of sliding rapidly. It is therefore advantageous that, during this phase, the piston should not be slowed down in its translation through the thimble. Thus, according to an advantageous characteristic, the seal of the thimble is broken beyond a defined longitudinal position of the separating element. This characteristic also allows the distribution circuit to be put into communication with the pressurization gases in order to purge it during the fifth phase of the discharge.

The continuity of the seal of the thimble between both defined longitudinal positions of the piston may be ensured by the longitudinal elastic extension of said thimble particularly if the latter consists of a flexible material. However, advantageously, this longitudinal extension is facilitated when the thimble includes at least one fold capable of being unfolded under the effect of the translational movement of the separating element. With this characteristic, it is possible to use for making up the thimble, a thicker therefore more pressure-resistant material and, if necessary, more temperature-resistant during the first two phases of the discharge. This embodiment is therefore particularly advantageous when the device includes a pyrotechnic gas generator in communication with the pressurization chamber, the triggering of which allows the discharge to occur.

By the combination of these characteristics, a compact ejection device may be formed, the seal of which between the chambers is strengthened. Advantageously, such a device includes a device capable of putting the pressurization chamber in communication with the outside in order to retain constant pressure therein with regard to the slow volume variations and close said chamber with regard to pressure and volume variations generated by the activation of the pyrotechnic gas generator. With this characteristic, it is possible to keep the ejection device free of any internal overpressure outside the operating phases, which improves its safety and allows reduction of its bulk and weight. Indeed, as it is not permanently subject to internal pressure, the device may be built with walls of smaller thickness without degrading its reliability towards risks of bursting.

According to an embodiment which is particularly adapted to the use of a fluid ejection device as a fire-fighting device, the latter includes means capable of putting the gases generated by the pyrotechnic reaction in communication with the fluid distribution circuit upon ending ejection of the fluid. The circuit may thereby be purged on the one hand and thus benefit from the whole amount of the extinguishing agent, and a discharge in two phases may also be obtained: the first consisting of pouring a large amount of extinguishing agent onto the fire, the second consisting in blowing onto the fire area an aerosol consisting of the gas generated by the pyrotechnic reaction and of the extinguishing agent.

By injecting a pure agent in this first discharge phase, it is thereby possible to obtain maximum concentration of the extinguishing agent which is the most often sought criterion within the scope of certification of an extinguishing system in particular for engine fire extinction applications in the aeronautic field.

In the second phase, by ejecting the aerosol formed by the pressurization gas, the actual nature of the gas (inert) may usefully participate in the extinction phase on the one hand, and the agent may be properly distributed wherever it is useful in the fire area to be treated on the other hand.

A device according to the invention may include means capable of preventing any return of gas or fluid from the distribution circuit into the reservoir after complete discharge of the latter. This allows an increase in the efficiency of the device and notably maximization of the ratio between the actually poured fluid and the fluid initially contained in the reservoir; this also allows parallel coupling on the same distribution circuit of several reservoirs of this type in order to have available a larger amount of fluid to be ejected. In this case, the different reservoirs are sequentially triggered without any risk that the discharge of one of the reservoirs fills another of them, already emptied, instead of being poured at the targeted point.

For using the device according to the invention for fire-fighting, the fluid to be ejected is advantageously an extinguishing agent of the fluoroketone type.

Alternatively, such a device may also be used as an ultimate emergency hydraulic generator; in this case the ejected fluid is hydraulic oil which may thus ensure ultimate emergency pressurization of any hydraulic circuit.

Such devices are more particularly suitable for use in aircraft, because of their compactness, their reliability and their reduced weight and of their low sensitivity to pressure and temperature variations.

The object of the invention according to another aspect of the invention is an ejection device for ejecting a fluid including:

- a reservoir comprising a cylindrical body sealably closed at its ends by first and second end portions, said reservoir comprising said fluid,
- means for generating pressurized gas,
- a rigid separation means, mobile along the axial direction of said reservoir, localized between the first end portion and said fluid so as to sealably form a first enclosure and a second enclosure containing said fluid, and
- communication means for putting the reservoir in communication with said generation means so that the gas generated by said generation means may penetrate into said first enclosure of said reservoir,
- an ejection orifice located in the second end portion, a pressure control means being positioned in the first end portion, and capable of adopting an open configuration in the absence of said generated pressurized gas in the reservoir so as to ensure that said first enclosure is exposed to the open air of the outside environment regardless of the axial position of the separation means, and a closed configuration in presence of said generated pressurized gas in the reservoir so as to provide the seal of said first enclosure.

Advantageously, closing of the pressure control means is controlled by the pressure exerted by said generated pressurized gas in said first enclosure.

In an embodiment of the invention, the pressure control means comprises a valve body with a substantially tubular shape, the inner face of which includes a valve seat, said valve body including at least one conduit for communicating with the outside environment of the reservoir, and a mobile part along the axial direction of the valve body and including a head adapted so as to come into contact with said valve seat thereby defining said closed position of the valve.

Advantageously, the pressure control means further comprises a separation means mobile along the axial direction of the valve body and positioned radially between the valve body and the mobile part, said separation means being capable of moving so as to face said communication conduit of the valve body.

Preferably, as the ejection device comprises distribution means connected to the ejection orifice, said communication conduit of said valve body is connected to said distribution means.

Preferably, a spring means is positioned in said first enclosure of said reservoir so as to exert a compressive force on said separation means along the axial direction of said reservoir, towards the second end portion, regardless of the axial position of the separation means.

In an embodiment of the invention, the ejection device for ejecting a fluid includes:

- a reservoir comprising a cylindrical body sealably closed at its ends by first and second end portions, said reservoir comprising said fluid,
- means for generating a pressurized gas,
- a rigid separation means, mobile along the axial direction of said reservoir, localized between the first end portion and said fluid so as to sealably form a first enclosure and a second enclosure containing said fluid, and
- communication means for putting the reservoir in communication with said generation means so that the gas generated by said generation means may penetrate into said first enclosure of said reservoir,
- an ejection orifice located in the second end portion, said ejection device including a spring means positioned in said first enclosure of said reservoir so as to exert a compressive force on said separation means along the axial direction of said reservoir, towards the second end portion, regardless of the axial position of the separation means.

Advantageously, the separation means is a heat insulator so as to reduce heat exchanges between said fluid and said generated gas.

Preferably, the separation means comprises a heat insulation area substantially extending along the radial direction of said separation means.

In an embodiment of the invention, as the cylindrical body of said reservoir comprises an inner circumferential shoulder located in proximity to said second end portion, the separation means comprises at least one blocking means exerting a thrust along the radial direction of the reservoir, so that said blocking means expands along the radial direction of the reservoir when said separation means is located facing said shoulder and blocks the displacement or the separation means towards the first end portion of the reservoir.

In another embodiment of the invention, as the separation means comprises at least one communication conduit, the cylindrical body of said reservoir comprises an inner circumferential shoulder in proximity to said second end portion; at least one recess is located in the inner face of the second end portion or in the face of the separation means, so that the generated gas flows up to the ejection orifice when the separation means is substantially located facing said shoulder of the cylindrical body of the reservoir.

Alternatively, the separation means comprises a central portion substantially extending along the diameter of said cylindrical body of the reservoir and a side portion substantially in contact with said cylindrical body, a breakage area extending circumferentially and located between said central portion and said side portion, said second end portion comprises a portion forming an abutment so that under the pressure of said generated gas, said central portion will come into contact with said abutment-forming portion thereby causing breakage of said breakage area of said separation means, so that the generated gas flows up to the injection orifice.

In another embodiment of the invention, a monitoring device is provided including a portion of an electric circuit positioned inside the reservoir so that the electric circuit is open when the separation means is located beyond a determined position towards the second end portion.

Advantageously, a monitoring device is provided including an electric circuit in which at least one electric wire connects said first end portion to said separation means, said wire having a determined length so that there is breakage or disconnection of said wire if the separation means moves beyond a determined position towards the second end portion.

Preferably, the ejection device comprises a distribution cap sealably closing the ejection orifice and distribution means connected to the ejection orifice.

Preferably, the means for generating a pressurized gas include a gas generator comprising an enclosure provided with a gas outlet orifice and a determined amount of gas generating pyrotechnic material.

The present invention also relates to the use of the ejection device including the characteristics which have just been defined, as an emergency hydraulic generator for an aircraft so as to provide hydraulic energy capable of causing mechanical action.

Advantageously, said fluid is an oil.

The invention also proposes according to an other aspect of the invention, a fluid ejection device comprising a number N of reservoirs of said fluid capable of being emptied sequentially. N being equal to or greater than 2, the N reservoirs being connected in parallel to the same circuit for distributing fluid through connections including a cap capable of being torn under the effect of a defined differential pressure, at least N-1 reservoirs include means capable of definitively blocking said connection with the circuit inside the reservoir upon ending the emptying. As the connection with the circuit is blocked upon ending the emptying for each fluid reservoir, it is possible to sequentially trigger the emptying of any other reservoir without any risk that the fluid will fill the already emptied reservoirs instead of being directed towards the points where it is useful, for example towards the fire extinguishing areas. With this multi-reservoir solution, it is possible to have a larger available amount of fluid to be ejected, in smaller reservoirs, therefore more easily integrable in a confined environment, without causing excessive pressure loss in the distribution circuit, because of the absence of valves or gates in said circuit, which also has the advantage of simplifying its installation and maintenance while improving reliability.

Said emptying devices may be of the type << with a membrane >> as described in EP1819403, modified so that the means for tearing the membrane upon ending the emptying are suppressed and replaced with a suitable form so that the membrane will fit the orifice of the connection with the distribution circuit and that the latter, under the effect of pressure generated in the reservoir by the gases of the pyrotechnic generator, blocks this orifice. However, said reservoirs advantageously consist of piston devices in which the ejection of the fluid from a reservoir of a substantially cylindrical shape is produced by translational movement of a piston acting on the fluid. The displacement of the piston may be caused by any means known to one skilled in the art, for example via an electric, hydraulic or pneumatic actuator, it may also be produced by the direct action of a magnetic field on the piston or by introducing a pressurized gas behind the piston in a similar way to that of the membrane device. As compared with a membrane device, with such a piston device, it is possible to ensure better emptying of the reservoir, in the fashion of a syringe, but it also simplifies the blocking of the orifice at the end of travel, the face of the piston blocking the orifice of the connection with the distribution circuit either by direct contact or by suitable sealing means.

According to this embodiment, it is absolutely necessary to keep the force applied on the piston or the membrane, via the actuator or the gas pressure at the end of travel so that the latter keep the connection blocked.

According to a more advantageous embodiment, the device includes means for locking the position of the piston at the end of travel. Under these conditions, in order to keep the force blocking the connection to the distribution circuit at the end of travel, it is not necessary to keep the actuators under load or the gas acting on the piston under pressure, which allows improvement in the operating reliability of the device with respect to pressure losses of the devices applying the force on the piston, but also safety of goods and persons after triggering the device thereby avoiding the keeping of pressurized elements, with the risk of explosion and of sudden depressurization which this may incur.

According to a particularly advantageous embodiment, the reservoirs include two chambers separated by the piston, one of the chambers including the fluid to be ejected, the displacement of the piston being caused by gas pressure introduced into the other chamber. As compared with an embodiment in which the displacement of the piston is obtained by the action of a pneumatic, hydraulic or electric actuator, this embodiment is more compact because of the absence of an actuator, and easier to install in a confined environment. The means for generating pressurized gas may be moved away from the installation location of the device which is then connected to these means through suitable pipes, said pipes may be rigid or flexible.

According to a still more advantageous embodiment, the pressurized gas is generated by pyrotechnic means. As said means are very compact, they may be directly installed in each fluid reservoir or in close proximity to the latter. Under these conditions, each fluid reservoir forms a self-contained device, particularly compact and easy to integrate, the triggering means only requiring very little maintenance because of the considerable reduction in the number of components and of mobile parts.

In order to ensure that the whole of the ejected fluid from each reservoir into the distribution circuit actually reaches its point of use with sufficient flow rate, particularly in the case when such a device is used for ejecting a fluid capable of fighting a fire, it is advantageous that the pressurization gases be injected in the distribution circuit upon ending the emptying of each reservoir so as to push the fluid towards its point of use and to completely empty the distribution network. Thus, the device will advantageously include means capable of pressurizing the gas in communication with the distribution circuit upon ending the emptying. These devices may be formed by orifices made on the face of the piston forming a separation between the chambers, said orifices being closed by tared valves so that when there is no longer any fluid pressure exerted on the latter, i.e. upon ending the emptying when the piston is locked, they open in order to let through the pressurized gas towards the orifice for connection with the distribution circuit in order to thereby drive out the fluid. Said valves for example close under the action of a spring when the gas pressure becomes smaller than a determined value.

The springs should be properly weighted in order to prevent the valves from opening too early or not opening. This type of adjustment is however capable of changing over time, for example under the effect of the creep of the materials making up the spring-forming means. Checking and, if necessary, correcting this adjustment, entail complex maintenance operations requiring the opening of the fluid ejection devices. This is why, according to a more advantageous embodiment, the piston includes two sealed areas with the inner surface of the reservoir. Said areas are separated and positioned axially, forming an annular chamber between the piston and the inner face of the reservoir. Blockable communication orifices are placed between said annular chamber and the pressurization chamber, the annular chamber being put into communication with the chamber containing the fluid at the end of travel of the piston. According to this embodiment, the piston includes a skirt. The blockable orifices are transversely located on said skirt and communicate with the annular chamber which is both isolated from the fluid and from the pressurized gas by the two sealed areas during the whole emptying operation. Said orifices are closed by adjusted valves as earlier. When the piston arrives at the end of travel, i.e. upon ending the emptying, and when it is locked, the inner surface of the reservoir comprises a shoulder with larger diameter, so that the first sealed area is no longer in contact with the wall of the reservoir thereby putting the annular chamber comprised between both sealed areas in communication with the chamber containing the fluid (emptied) and the orifice for connection to the distribution circuit. The applied gas pressure on the piston in the other chamber causes opening of the valves blocking the orifices made on the skirt of the piston putting the gas in connection with the annular chamber, therefore with the distribution circuit. When the pressure decreases below a given value, spring-forming means close the blocking valves. This configuration is advantageous since it does not require any specific loading of the valve springs. Indeed, even if the latter open under the effect of the pressure during the emptying, this does not cause any leakage of gas which cannot mix with the fluid, the annular chamber being sealably closed by the two sealed areas. This is particularly important in the case when the ejected fluid is a fluid capable of fighting fire such as a fluoroketone, for example a fluid commercially known under the name of NOVEC® 1230 of the 3M brand. This type of fluid which has very high specific heat would absorb the calories of the pyrotechnic reaction if the gases generated by this reaction would come into contact with it, which would have the consequence of reducing the efficiency of the ejection of the fluid. Thus, by positioning the blockable orifices on the skirt of the piston, which open into a sealed annular chamber, it is possible to avoid any contact of the gases with the fluid ejected during the emptying on the one hand, but also obtain efficient thermal insulation by the front face of the piston between the fluid and the gases.

According to a simpler and more advantageous embodiment, the means for blocking the orifices are formed by an elastic ring. As said elastic ring is positioned in the annular chamber around the skirt of the piston and will by elasticity block the orifices made in this skirt. The characteristics of the ring in terms of material and geometry, are selected so that the latter may be expanded and may thereby open the orifices. This configuration allows simplification of the device for blocking the orifices which may thus be more numerous and promote rapid evacuation of the gases at the end of the emptying so as to ensure high fluid flow rate in the distribution circuit during the whole cycle and thereby limit the pressure losses.

According to a particular embodiment, the elastic ring is formed by a slit ring. This embodiment is particularly economical and reliable, the additional expansion possibilities given by the presence of this slit also facilitating the mounting of the ring. The slit is further used for ensuring the angular position of said ring so that it cannot rotate in its housing and the slit will not be facing an orifice which would cause a loss of the seal.

Such a fluid ejection device may be easily integrated into a confined environment such as the pod of an aircraft engine, since it is compact and easily integrable, it is not under pressure before and after the emptying phase, and may thus be installed as close as possible to the fire sources without generating any risks, notably risks of explosion, for the surrounding installations, and finally, it only requires very limited maintenance. It may therefore be installed in areas which have limited accessibility without causing excessive maintenance costs.

Alternatively, such a device may be used as an emergency hydraulic generation device for an aircraft. With such a device hydraulic energy may be provided, required for operating a mechanical control, for example for applications of the braking type and steering on the ground, or even opening and locking the landing gear. For this type of use, the expelled fluid is hydraulic oil. In this case it is preferable not to promote emptying by expelling the gases into the distribution circuit so as to avoid mixing gases and oil. The presence of several reservoirs in parallel allows several maneuvers to be carried out by triggering the latter sequentially.

SHORT DESCRIPTION OF THE DRAWINGS

Embodiments of the invention will now be described as non-limiting examples with reference to the appended drawings, wherein:

FIG. 1, already described, is a schematic view of a device according to the prior art coupling several reservoirs and applying controlled valves and anti-return valves on the distribution circuit;

DETAILED DISCUSSION OF PARTICULAR EMBODIMENTS

FIGS. 2-8 represent a first aspect of the invention.

Figure 2A:
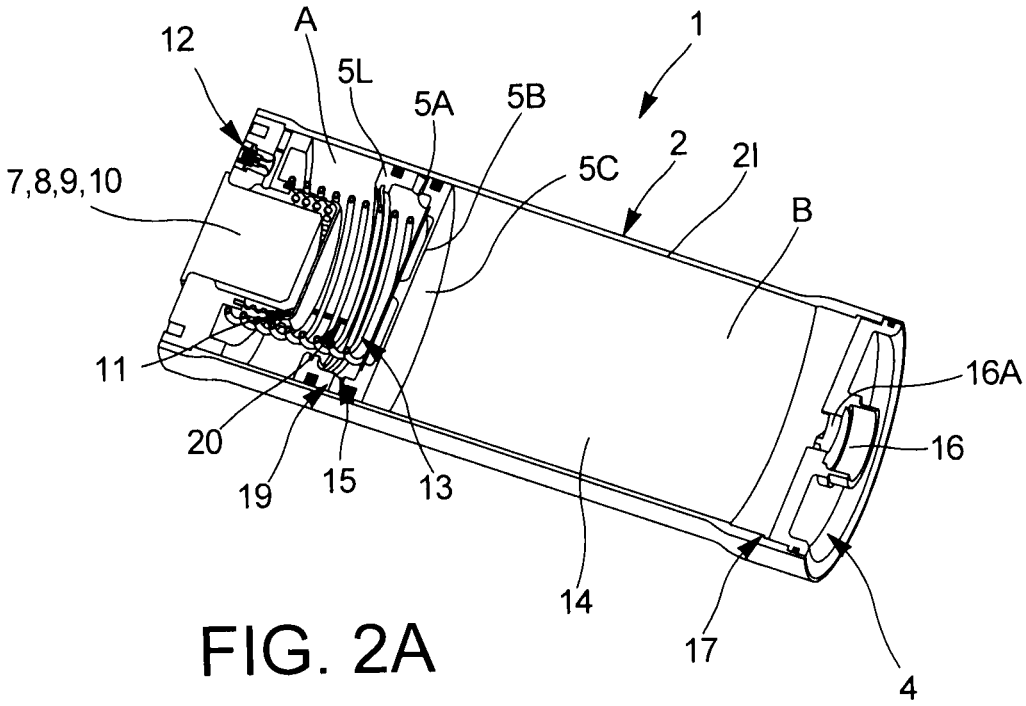
FIGS. 2A and 2B are perspective views of a longitudinal section of the fluid ejection device according to the invention.
Figure 2B:
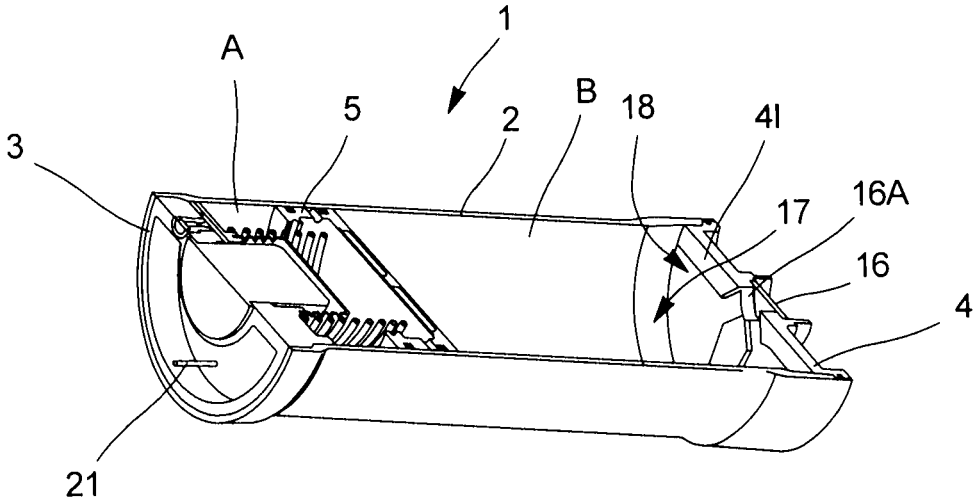

As illustrated schematically in FIGS. 2A and 2B, the fluid ejection device comprises as a main element, a reservoir 1 containing the fluid 14 to be ejected, formed by a hollow cylindrical body 2, sealably closed at two ends by a first end portion 3 and a second end portion 4. The cylindrical body 2 may have a circular, elliptical, oblong section, or any other shape of the same kind. The invention more particularly applies to a fluid 14 in the liquid phase. Nevertheless, the fluid 14 may also appear as powders, as pasty fluids or slurries.

The reservoir 1 includes one or more ejection orifices 16A, which may be connected to distribution means (not shown) in order to allow ejection of the fluid 14 and its conveyance up to a determined area. The ejection orifices 16A are located in the second end portion 4 of the cylinder and in proximity to this end portion. Advantageously, each ejection orifice 16A is sealably closed by a distribution cap 16 in order to keep the fluid in the reservoir 1 as long as its action is not requested. In particular, if the ejection orifice 16A is a single one, the distribution cap 16 may for example be a tared cap, i.e. a membrane which breaks or opens as soon as the pressure inside the reservoir 1 reaches a certain threshold. The distribution cap may also be advantageously a remote-controlled valve. Other closing devices are for example known from WO 93/25950 or U.S. Pat. No. 4,877,051, and available commercially.

The ejection device according to the invention includes means for generating a pressurized gas. The means for generating a pressurized gas are connected to the reservoir 1 via communication means. Advantageously, the communication means between the reservoir 1 and the means for generating a pressurized gas open into the reservoir 1 oppositely to the ejection orifice 16A, i.e. in the first end portion 3 or in proximity to this end portion. The means for generating a pressurized gas may in a non-illustrated embodiment of the invention consist in one or more reservoirs of pressurized gas. In this case, a valve in the communication means for example allows the pressurized gas reservoir to be isolated from reservoir 1 as long as the latter is not used.

Another embodiment relates to a gas generator 7. Advantageously, for reasons of congestion, and as illustrated in FIGS. 2A and 2B, the generator 7 is located inside the reservoir 1. It consists of a combustion enclosure 8 provided with an ignition device 9, and containing a suitable amount of an energy-giving or pyrotechnic material. This material may be in the solid state, for example as beads or tablets, or further as a block with a carefully designed shape. The gases generated by the combustion of the energy-giving or pyrotechnic material are directed towards the reservoir via outlet orifices of the enclosure 8. Such generators 7 are known to one skilled in the art. Advantageously, a diffuser 11 placed around the combustion enclosure 8 allows better distribution of the gas generated by the gas generator 7 within the first enclosure A, which minimizes the thermal impacts localized at the surface of the first enclosure A.

In the ejection phase, said fluid 14 may absorb a large amount of heat energy from the generated gas. This is notably the case of NOVEC® 1230 marketed by 3M. The heat absorbed by such a fluid 14 causes lowering of the temperature of generated gas, which produces a decrease in the pressure exerted by the gas generated in the reservoir 1 on the fluid 14 to be ejected. This pressure reduction applied to the fluid 14 to be ejected leads to a lower fluid ejection rate 14, which thus reduces the efficiency of the device according to the invention. In order to limit the heat exchanges between both phases, a separation means 5 is required.

The separation means 5 is localized between the first end portion 3 and said fluid 14 so as to sealably form a first enclosure A located between the separation means 5 and the first end portion 3, called a pressurization chamber, on the one hand, and a second enclosure B containing said fluid 14 located between the separation means 5 and the second end portion 4 on the other hand.

The separation means 5 may comprise a central portion 5C substantially extending along the radial direction of the reservoir 1, and a side portion 5L substantially extending along the axial direction of the reservoir 1. The side portion 5L is connected to the central portion 5C at the circumference of the portion 5C. The portions 5C and 5L are rigid. The central portion 5C of the separation means 5 comprises a surface 5A located in the first enclosure A and a surface 5B located in the second enclosure B.

The separation means 5 is mobile along the axial direction of the reservoir 1 so as to have a piston effect: in the ejection phase, the surface 5A is subject to the pressure of the generated gas, a pressure which is imparted to the fluid 14 through the surface 5B of the central portion 5C so as to eject the fluid 14 from the reservoir 1.

Preferably, the separation means 5 is in a thermally insulating material, for example in plastic material, or in any rigid material, covered with an insulating material such as an elastomer. Thus, the fluid 14 cannot absorb the energy of the generated gas, which optimizes the ejection efficiency of the device according to the invention.

The separation means 5 may include seal gaskets or segments 6, placed in circumferential recesses of the side portion 5L facing the inner wall 2I of the cylindrical body 2. With the seal segments 6 rubbing on the inner wall 2I of the cylindrical body 2, any mass transfer may be prevented between the enclosures A and B.

In addition to the advantage of avoiding any heat transfer, the separation means 5 also has the advantage of avoiding any mixing and any dilution of the fluid 14 in the generated gas which would decrease the efficiency of the ejection device. This non-dilution of the fluid 14 in the generated gas is particularly important for certain applications such as extinguishing an engine fire in aeronautics where, for regulatory reasons, a minimum concentration of extinguishing agent should be provided in a relevant fire area during a given period, as described in document EP1552859 filed in the name of the applicant. Indeed, these fire areas are most often ventilated by a significant renewed air flow. Also, it is essential to inject the extinguishing agent as pure as possible into said area very rapidly, in order to obtain the certification criterion by using a minimum amount of extinguishing agent, still with the purpose of minimizing the weight of the extinguisher.

Figure 3:
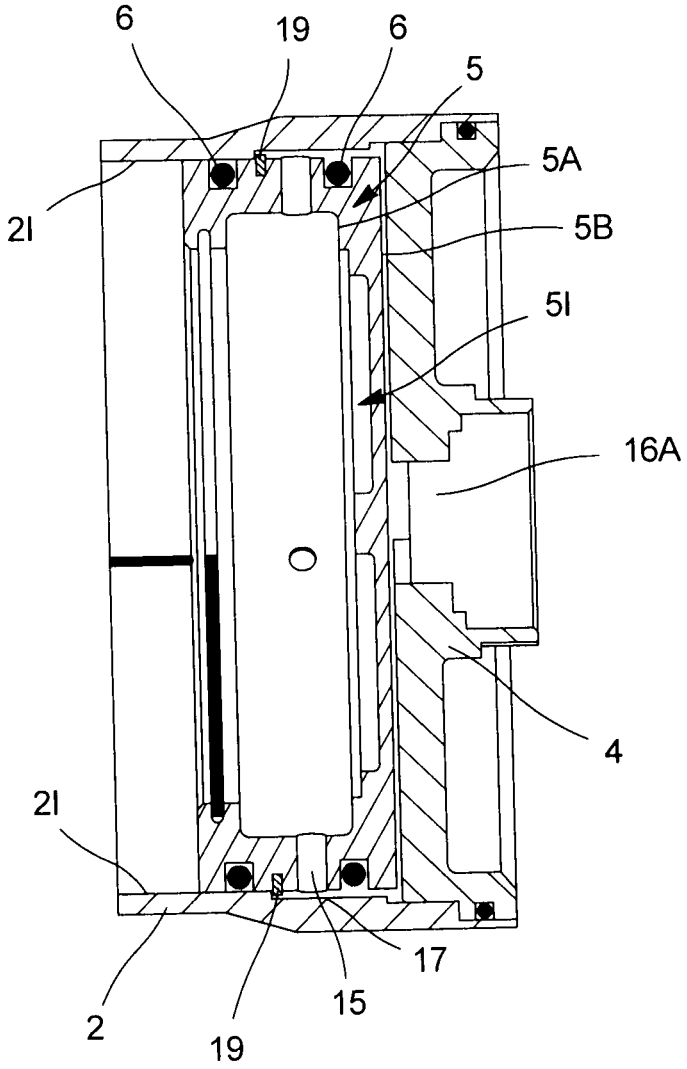
FIG. 3 is a sectional view of the separation means and of the second end portion according to an embodiment of the invention.

In an embodiment of the invention illustrated in FIG. 3, the separation means comprises a heat insulation area 51 substantially extending along the radial direction of the separation means 5. This heat insulation area 51 may be a closed recess located inside the central portion 5C between the surfaces 5A and 5B of the separation means 5, as illustrated in FIG. 3. Other solutions are possible, such as the covering of a surface 5A or 5B, or of both surfaces 5A and 5B, with a plate in a heat insulating material and with a suitable thickness. The heat insulation between the first enclosure A and second enclosure B is thereby improved.

Figure 4:
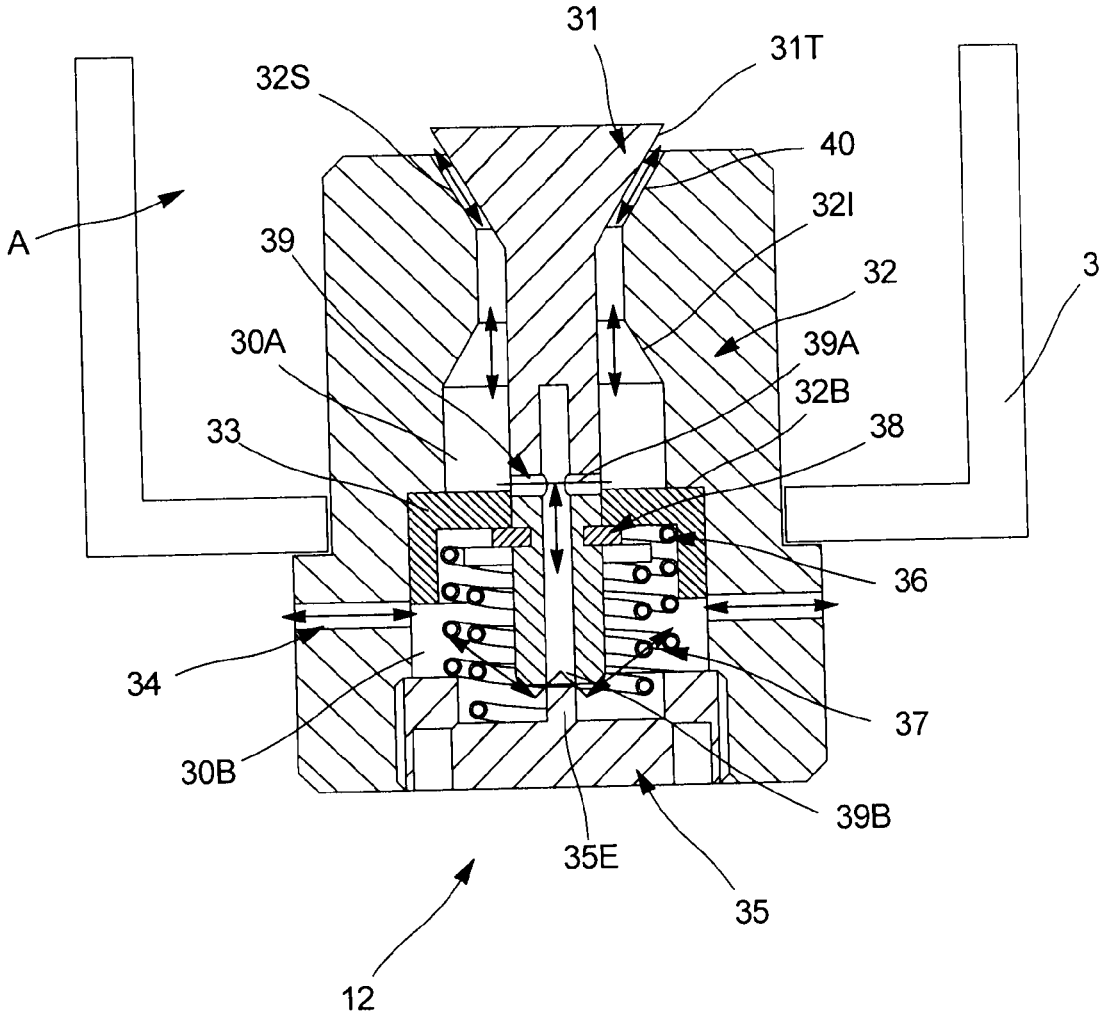
FIG. 4 shows a longitudinal sectional view of a pressure control means with which the ejection device according to the invention is equipped.

FIG. 4 shows a pressure control means 12 with which the fluid ejection device according to the invention is equipped. The ejection device according to the invention may be equipped with several pressure control means 12. FIG. 4 shows a non-limiting example of a pressure control means, here corresponding to a valve. However other means may be suitable, such as for example a gate or a valve. The pressure control means 12, designated as a valve subsequently, is positioned in the first end portion 3 so as to ensure communication between the first enclosure A and the outside environment of the reservoir. The valve 12 is capable of adopting an open configuration in the absence of generated gas in the reservoir 1 so as to ensure that said first enclosure A is exposed to the open air and a closed configuration in the presence of gas generated in the reservoir 1 so as to ensure the seal of said first enclosure A, and this regardless of the axial position of the separation means 5. The valve 12 is designed so as to sealably close under the pressure of the gas generated in the first enclosure A. Thus, a slow pressure variation between the first enclosure A and the outer environment of the reservoir 1 through the valve 12 is not capable of actuating the closing of the valve 12. This slow variation type appears when the atmospheric pressure varies outside the ejection device according to the invention, for example because of the altitude variation of the aircraft. It may also appear upon displacement of the separation means 5 depending on the volume variation of the fluid 14, and therefore on the pressure variation in the first enclosure A because of the displacement of the separation means 5. Indeed, depending on the temperature of the surrounding air, the fluid 14 may have a volume variation relatively to a reference volume defined for a given temperature, for example +20° C. In the case of high temperatures, the fluid 14 has bulk expansion and then exerts pressure on the separation means 5 in the direction of the first end portion 3. The separation means 5 then moves towards the first end portion 3.

Thus, any displacement of the separation means 5 because of the volume variation of the volume 14 will modify the volume of the first enclosure A and therefore the prevailing pressure inside this enclosure A. Thus, exposing the first enclosure A to open air via the valve 12 ensures that none of the enclosures A and B of the ejection device according to the invention is pressurized during the out-of-ejection phase.

On the other hand, rapid and large variation of pressure in the first enclosure A because of the generation of pressurized gas is capable of causing the closing of the valve 12.

Thus, by exposing the first enclosure A to open air ensured by the valve 12, it is possible to have in the ejection device according to the invention, pressurized gas during the out-of-ejection phase, and this regardless of the axial position of the separation means 5. Any unnecessary mechanical stress which would make the ejection device fragile is thereby avoided. Further, in the case of a use of the invention on an aircraft, the fact that the internal pressure of the fluid ejection device is always balanced with the outside enables it to be installed as close as possible to the areas to be supplied with fluid 14, while facilitating the response to constraints imposed by aeronautical regulations. With this it is also possible to reduce the length of the distribution conduit connecting the ejection device to the relevant areas. The linear pressure loss in the distribution conduit is therefore reduced with which it is possible to obtain a larger fluid flow rate 14 for a given ejection pressure. The ejection efficiency of the device is thereby improved. Finally, by reducing the length of the distribution conduit and by optimizing the thickness of the walls of the ejection device, it is possible to meet the mass-saving requirements in aeronautics.

With reference to FIG. 4 showing an embodiment of the invention, the valve 12 comprises a valve body 32 preferably attached to the first end portion 3 of the reservoir 1. The valve body 32 is hollow and preferably with a substantially tubular shape. It allows gas communication between the first enclosure A and the outside environment of the reservoir 1. A plug 35 will sealably close the portion of the valve body 32 communicating with the outside environment. Said valve body 32 comprises at least one communication conduit 34 connecting the inside of the body of the valve 32 to the outside environment of the reservoir 1. The inner face 321 includes a valve seat 32S substantially located in proximity to the end of the valve body 32 communicating with the first enclosure A. A mobile part 31 is capable of moving along the axial direction of the valve body 32 and includes a head 31T adapted so as to come into contact with said valve seat 32S thereby defining said closed position of the valve.

The valve 12 further comprises a mobile separation means 33 along the axial direction of the valve body 32 and located radially between the valve body 32 and the mobile part 31, said separation means 33 being adapted so as to face said communication conduit 34 of the valve body, so as to block any flow of generated gas through the communication conduit 34, thereby forming a second closure safety device. At rest, the mobile separation means 33 bears against a portion forming an abutment 32B of the valve body 32, under for example the action of a spring 36, compressed between the mobile separation means 33 and the plug 35, so that the separation means 33 is not facing said communication conduit 34.

The mobile part 31 bears upon the mobile separation means 33 via a part forming an abutment 38 interdependent on the mobile part 31, under the action of a compressed spring 37 between the part forming an abutment 38 and the plug 35. It defines a first valve enclosure 30A communicating with the first enclosure A of the reservoir 1 and a second valve enclosure 30B communicating with the outside environment. Both enclosures 30A and 30B communicate with each other via communication conduits 39 located inside the mobile part, comprising an inlet 39A substantially located in the first valve enclosure 30A and an outlet 39B located in the second valve enclosure 30B.

Figure 5A:
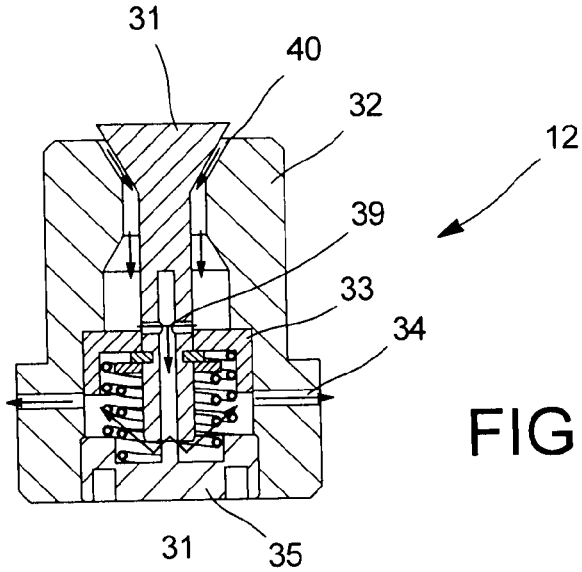
FIGS. 5A, 5B and 5C are three longitudinal sectional views of the pressure control means during operation.

As illustrated in FIG. 5A, the exact positioning (by design or by adjustment) of the part forming an abutment on the mobile part 31 determines slight play 40 between the mobile part and the valve body 32 thereby allowing communication between the first enclosure A of the reservoir 1 and the outside environment, via conduits 34 of the body 32 and conduits 39 of the mobile part 31.

In order that the valve 12 closes under the pressure of the gas generated in the first enclosure A, the play 40 and the communication conduits 34 and 39 have a size which do not allow inertial flow. With this purpose, a characteristic size of the play 40 and of the conduits 34 and 39 may be of the order of one millimeter.

Figure 5B:
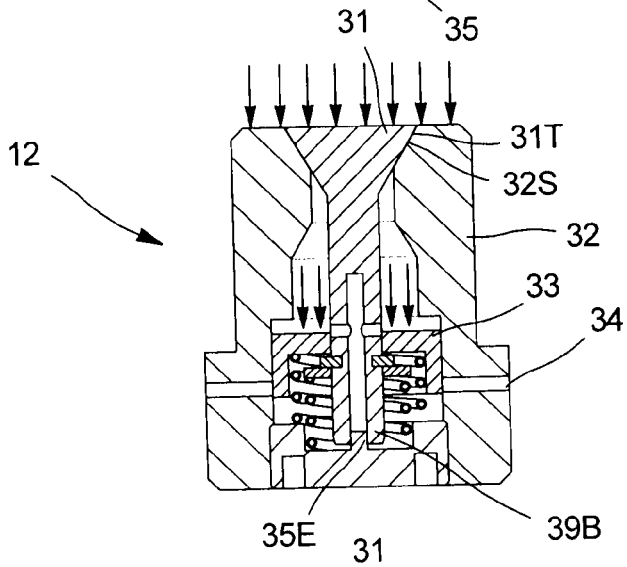
Figure 5C:
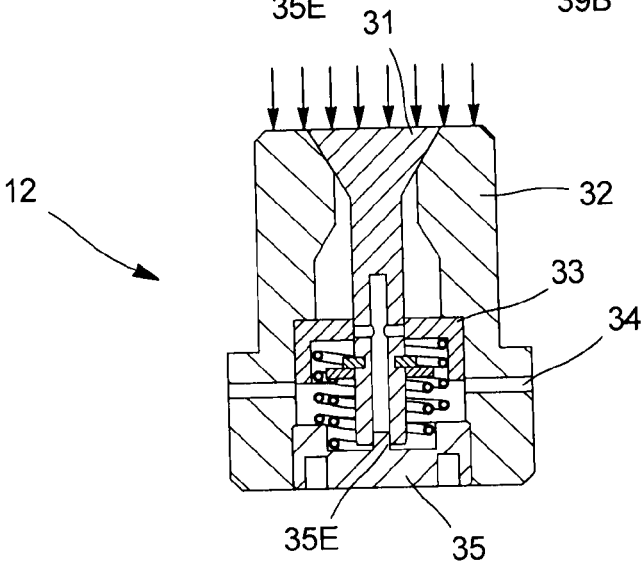

During the ejection of the fluid under the action of the generated gas, as illustrated in FIGS. 5B and 5C, from the beginning of the pressurization of the first enclosure A of the reservoir 1, the head 31T of the mobile part 31 will contact the seat 32S of the valve body 32 by the combined action of the pressure on said mobile part 31 as well as on the mobile separation means 33 which moves back until it comes into contact with the part forming an abutment 38 interdependent on the mobile part 31. As shown in FIG. 5B, the mobile separation means 33 in its movement, blocks the conduit 34 of the body 32, which ensures a double seal (contact between the head 31T of the mobile part 31 with the seat 32S of the body 32 on the one hand, and closing of the conduits of the body 32 by the separation means 33 on the other hand). Further when the mobile part 31 is closed, the inlet 39A of the conduit 39 of the mobile part 31 is blocked by a lug 35E interdependent on the plug 35.

If a slight leak occurs between the separation means 33 and the body 32 and then towards the conduit 34 of the body 32, as illustrated in FIG. 5C, this leads to lowering of the pressure on the separation means 33. Said separation means 33 pushed by the spring 36 will move until it comes back and bears on the body 32 which has the effect of blocking the conduits 39 of the mobile part 31, thereby re-establishing a double seal.

Figure 6A:
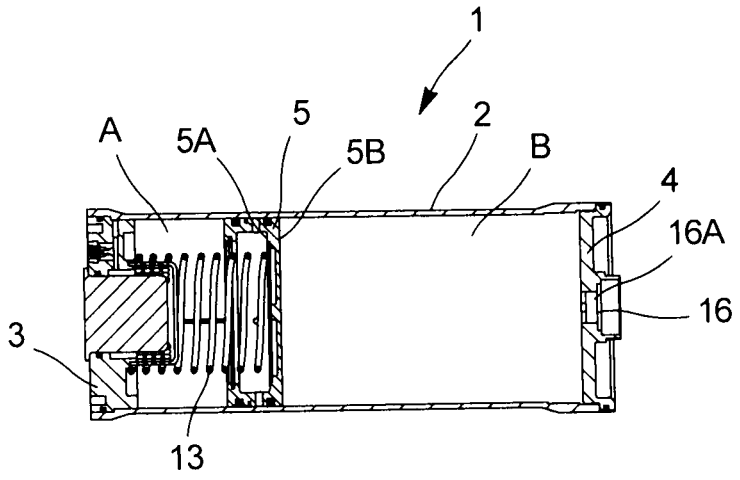
FIGS. 6A, 6B and 6C are top views of a longitudinal section of a fluid ejection device for three exemplary positions of the separation means.

With reference to FIGS. 2A and 2B, a spring means 13 may be positioned in said first enclosure A of said reservoir 1 and placed between the first end portion 3 and the separation means 5 so as to exert a compressive force along the axial direction of said reservoir 1 on said separation means 5, still oriented in the direction of the second end portion 4. This compressive force still oriented in the same direction, minimizes the volume of the second enclosure B and maintains permanent contact of the separation means 5 with the fluid 14 to be ejected. The surface 5B of the separation means 5 is thus entirely in contact with the fluid 14 to be ejected. FIG. 6A shows a spring means 13 as a coil spring, however other types of spring may be used.

Figure 6B:
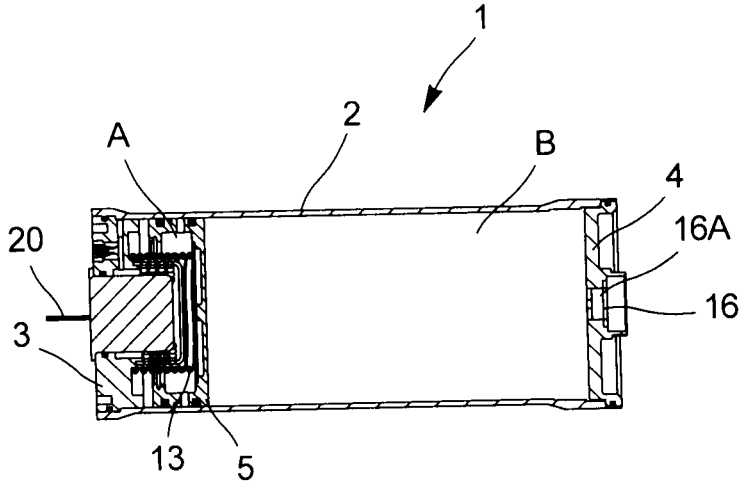

In the case of high temperatures, as illustrated in FIG. 6B, the fluid 14 has bulk expansion and then exerts pressure on the separation means 5 in the direction of the first end portion 3. The separation means 5 then moves in the direction of the first end portion 3. The spring means 13 deforms and exerts in return a compressive force, still oriented towards the second end portion 4, on the separation means 5. The intensity of the force exerted by the spring means 13 depends on the intensity of the deformation of the latter. Thus, the surface 5B of the separation means is entirely and permanently maintained in contact with the fluid 14 to be ejected, and the second enclosure B has minimum volume.

In the case of low temperatures, the fluid 14 reduces its volume. Because of the pressure exerted by the spring means 13 on the separation means 5, the separation means 5 moves in the direction of the second end portion 4 so as to maintain full and permanent contact between the surface 5B of the central portion 5C of the separation means 5 with the fluid 14 to be ejected. The second enclosure B always has minimum volume.

Thus, because there is permanent contact between the sealed separation means 5 and the fluid to be ejected 14, no mixing occurs between the generated gas and the fluid 14 inside the reservoir 1 during the whole phase for ejecting the fluid 14. Thus, the ejected fluid 14 arrives in the area to be supplied with the fluid 14 with maximum concentration, which increases the efficiency of the ejection device according to the invention. Further, in the absence of any spring means 13, a delay time is present which corresponds to the time during which the separation means 5, when it is no longer in contact with the fluid 14, will come into contact with the fluid 14. By the spring means 13, there is no delay time upon ejecting the fluid 14 since the pressure exerted by the generated gas on the separation means 5 is immediately transmitted through the separation means 5 to the fluid 14 to be ejected. Let us also note that by minimizing the second enclosure B by the separation means 5 on which the spring effect is exerted, it is possible to get rid of any orientation constraint of the ejection device according to the invention. It is no longer necessary to orient the ejection device in the direction of gravity with the ejection orifice 16A at the bottom. Further, the efficiency for ejecting the fluid 14 is improved since the face 5A of the separation means 5 is both subject to the compressive force from the spring means 13 and to the pressure of the generated gas, which increases the ejection rate of the fluid 14 through the ejection orifice 16A.

Within the scope of aeronautic applications, it is advantageous that a monitoring device continuously checks the integrity of a fluid ejection device, notably for an extinguishing application but also for an application as an emergency hydraulic generator.

In an embodiment of the invention, the monitoring device consists of an electric circuit such that the latter changes state between the open state and the closed state, when the separation means 5 is found in a determined axial position between the first end 3 and the second end 4. Advantageously, said electric circuit is open when the separation means is found between said determined position and the second end 4, and closed when it is found between the first end portion 3 and said determined position. This electric circuit consists of two electric conductors, for example electric wires or tracks, positioned on the inner face 2I of the cylindrical body 2 and extending along the axial direction of the reservoir 1. One of the ends of the wires is connected to an electric circuit via a sealed connector 21 located in the first end portion 3. The other end of at least one electric conductor is positioned at a determined distance from the second end portion 4, thereby defining an opening position of the electric circuit. Both conductors are electrically connected through the separation means 5, for example through the blocking means 19 also made in a conducting material. Thus, the separation means 5 ensures closing of the electric circuit when it is located between the first end portion 3 and said opening position, the circuit being open when it is located between said opening position and the second end portion 4. The opening of the circuit will be recognized by a monitoring system as a lack of integrity of the fluid ejection device.

Figure 6C:
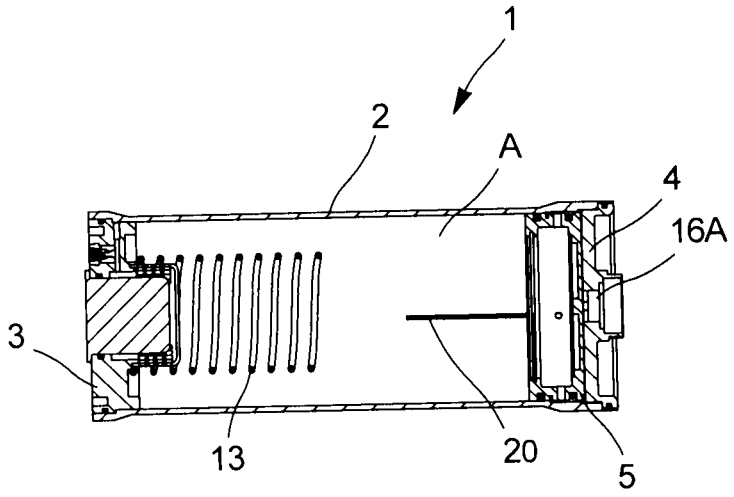

In another embodiment of the invention, the monitoring device 20 is formed by at least one conducting wire 20, preferably two in number, attached to the separation means 5 on the one hand and for example connected to a ground circuit via a sealed connector 21 located on the first end portion 3, as illustrated by FIGS. 6A, 6B and 6C. The length of the wire is adapted to the different positions which the separation means 5 may assume in the reservoir 1 depending on the extreme operating temperatures of the ejection device, as shown by FIGS. 6A and 6B. Thus, the wire does not undergo any excessive mechanical stress in the out-of-ejection phase. If the amount of fluid 14 decreases because of evaporation, for example related to a microleak, likely to more particularly occur with fluids which evaporate easily such as NOVEC® 1230 from 3M, the separation means 5 will continue its displacement towards the second end portion 4 of the reservoir 1 under the pressure exerted by the spring means 13. The stress on the wires will then continuously increase. As this is shown by FIG. 6C where the unloaded ejection device is seen, beyond a determined position of the separation means 5, the stress will cause the breaking or the disconnection of at least one of the wires.

The breakage or the disconnection of at least one conducting wire 20 causes opening of the ground circuit, an opening forming a signal which will be recognized by a monitoring system as a lack of integrity of the fluid ejection device 14 and will cause a maintenance operation during which the problem will be identified rapidly. It is possible to get rid of one of the two wires 20, for example insofar that the ground return is accomplished by the cylindrical body of the reservoir 1, by ensuring electric continuity between the separation means 5 and the cylindrical body 2 for example by using the means 19 for blocking the separation means 5 which will be described in detail later on. As the latter is in contact with the inner wall 2I of the cylindrical body 2 during the displacement of the separation means 5, ground continuity may be ensured.

In the same way as earlier, during the discharge of the ejection device, the separation means 5 by moving, will also rapidly cause the breaking or the disconnection of these wires, and therefore the opening of the ground circuit as illustrated in FIG. 6C. The event this time following a voluntary command from the ejection sequence, will be interpreted by the monitoring system as proof of the discharge of the ejection device, proof which is also a regulatory requirement in aeronautic applications.

FIG. 3 illustrates an embodiment of the invention in which the separation means 5 may have at least one communication conduit 15, preferably four in number, distributed at 90°, opening laterally and perpendicularly to the inner wall 2I of the cylindrical body 2. The cylindrical body 2 substantially includes a shoulder 17 in proximity to the second end portion 4. This shoulder 17 allows depressurization of the first enclosure A and complete ejection of the fluid 14 and subsequently of the generated gas into the distribution means. Indeed, when the separation means 5 is substantially in abutment at the end of travel in proximity to the second end portion 4, the first enclosure A is put into communication with the distribution means so that the generated gas flows through the orifice 15 placed facing the shoulder 17 and flows into at least one recess 18 located in the inner face 41 of the second end portion 4, right up to the ejection orifice 16A. The recess 18 may also be made on the face 5B of the separation means 5 so as to allow the generated gas to flow right up to the ejection orifice 16A. Thus, the fluid 14 is ejected and the generated gas is discharged into the distribution means. With this the fluid ejection device may be totally emptied, both in the fluid 14 to be ejected and the generated gas. This also allows the reservoir 1 to be exposed to open air and to thereby avoid any mechanical stress related to possible residual overpressure. With this, notably, the safety of an operator may be guaranteed, for example during a maintenance operation, since any risk due to intervention on the device still having internal overpressure is set aside.

In an embodiment of the invention, the separation means 5 is provided with a blocking means 19, as illustrated in FIG. 3. This blocking means 19, for example an elastic segment or a metal rod and spring assembly, is placed between the seal elements 6 and above the orifices 15, the function of which is to lock the separation means 5 at the end of travel, this in order to avoid any backward return of said separation means 5 by reaction to possible shock loading or by counterpressure in the distribution means which would be detrimental to the efficiency of the discharge. At the end of ejection of the fluid 14, the side portion 5L of the separation means 5 is facing the shoulder 17. By a spring effect, the segment moves along the radial direction of the reservoir 1 in this shoulder 17 and therefore forms a mechanical abutment preventing any backward return of the separation means 5.

Figure 7:
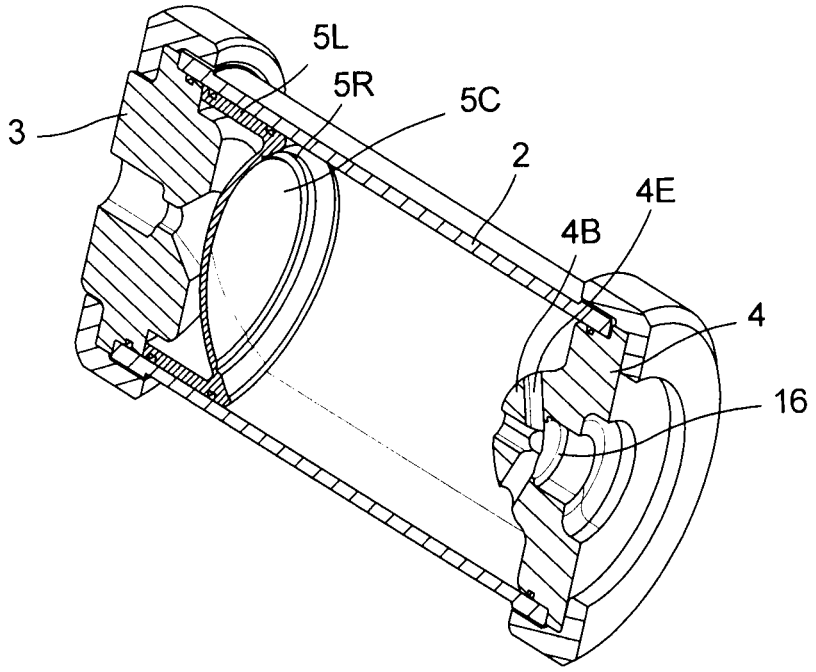
FIG. 7 is a perspective view of a longitudinal section of the ejection device according to an embodiment of the invention, wherein the separation means comprises a breakage area and the second end portion comprises a portion forming an abutment.

FIG. 7 illustrates an alternative embodiment of the invention in which the separation means 5 comprises a breakage area 5R extending at the circumference of the central portion 5C and located between the central portion 5C and the side portion 5L of the separation means 5. The second end portion 4 comprises a portion forming an abutment 4B so that, under the pressure of the generated gas, said central portion 5C will come into contact with the portion forming an abutment 4B thereby causing breakage of the breakage area 5R of the separation means 5, so as to allow communication between the first enclosure A and the ejection orifice 16A. Thus, the generated gas may be discharged and may then flow through the distribution means. With this, the fluid ejection device may be totally emptied, both of the fluid to be ejected and of generated gas. This also allows the reservoir 1 to be exposed to the open air and thereby avoids any mechanical stress related to possible residual overpressure.

Figure 8A:
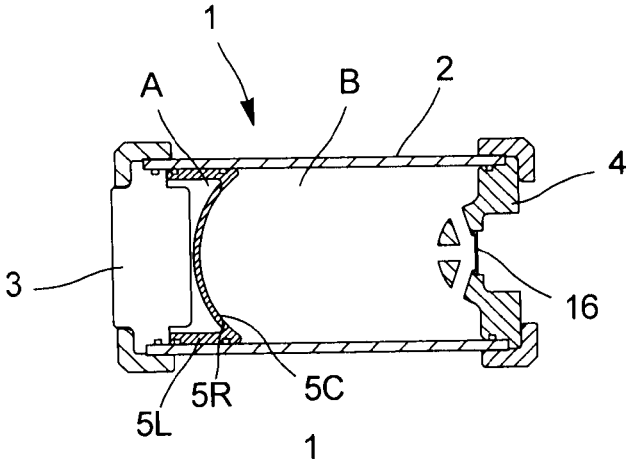
FIGS. 8A, 8B, 8C and 8D are longitudinal sectional views of the ejection device according to the embodiment shown in FIG. 6 for four instants of the ejection phase.
Figure 8B:
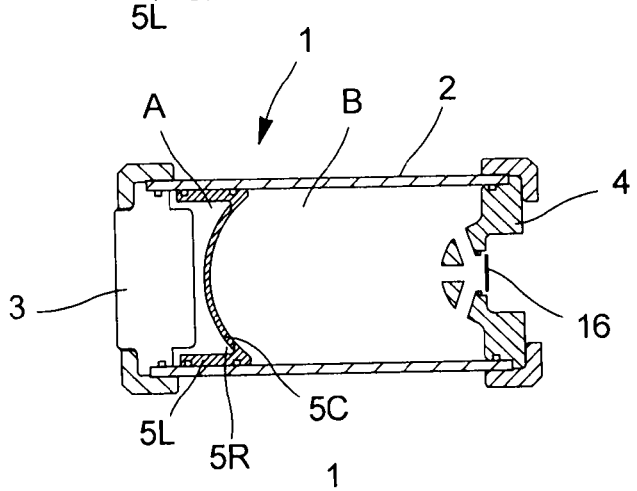
Figure 8C:
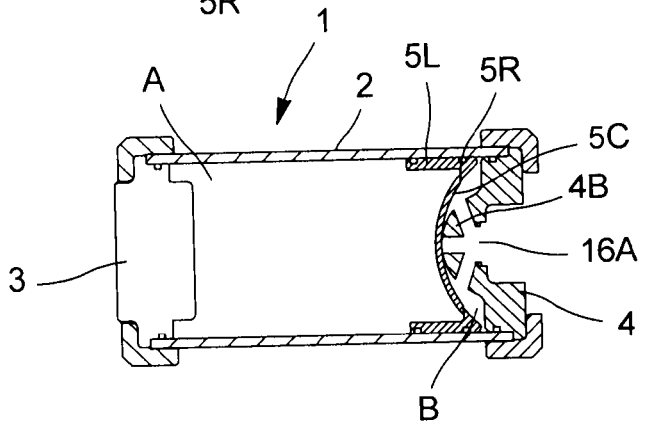
Figure 8D:
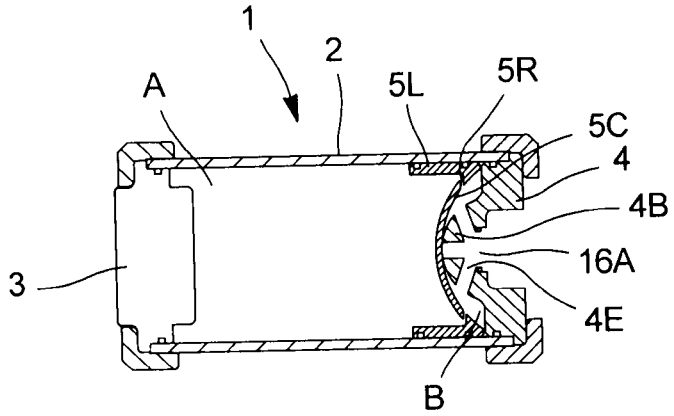

FIG. 8A shows the ejection device at rest according to the embodiment of the invention shown in FIG. 7. The spring means 13 is not illustrated for the sake of clarity of the figure. The separation means 5 is positioned in proximity to the first end portion 3. FIG. 8B shows the initial phase of the ejection in which the generated gas is introduced into the first enclosure A and exerts pressure on the surface 5A of the separation means 5. The separation means 5 then exerts a force on the fluid to be ejected 14 in the direction of the second end portion 4. Accordingly, the distribution cap 16 opens and the fluid 14 is discharged through the ejection orifice 16A. In FIG. 8C, the separation means 5 is moved towards the second end portion 4 under the combined effect of the pressure exerted by the generated gas and of the compressive force exerted by the spring means 13. The central portion 5C of the separation means has come into contact with the portion forming an abutment 4B of the second end portion 4, while the side portion 5L of the separation means 5 is not in contact with any portion forming an abutment. Also, the central portion 5C cannot continue to be displaced towards the second end portion 4 because of the contact with the portion forming an abutment 4B, while the side portion 5L may continue to be displaced. Thus, because of the acquired kinetic energy during displacement by the separation means 5, the side portion 5L will detach from the central portion 5C by breaking of the breaking area 5R. FIG. 8D shows the ejection device at the end of the ejection phase. The side portion 5L of the separation means 5 is detached from the central portion 5C and has abutted against the second end portion 4, thereby creating an opening extending circumferentially and located between the side portion 5L and the central portion 5C of the separation means 5. In the embodiment of the invention, illustrated in FIG. 8D, ejection conduits are provided in the second end portion 4 so as to allow discharge of the fluid 14 and of the generated gas right up to the ejection orifice 16A. Thus, the generated gas may be discharged and then flow through the distribution means. With this, the fluid ejection device may be totally emptied, both of the fluid to be ejected and of the generated gas. This also allows the reservoir 1 to be exposed to open air and to thereby avoid any mechanical stress related to possible residual overpressure.

The device may advantageously be used as a so-called "last emergency" hydraulic generation system for an aircraft. In this case, when the aircraft following an incident, has lost all its electric and hydraulic generations, such a device enables hydraulic energy to be provided, required for actuating mechanical control, for example for applications of the braking type, and steering on the ground, or even opening and locking of the landing gear when the characteristics of the gear do not allow these operations to be performed by simple gravity. For this type of use, the expelled fluid is hydraulic oil with suitable characteristics for the relevant application.

Figure 9:
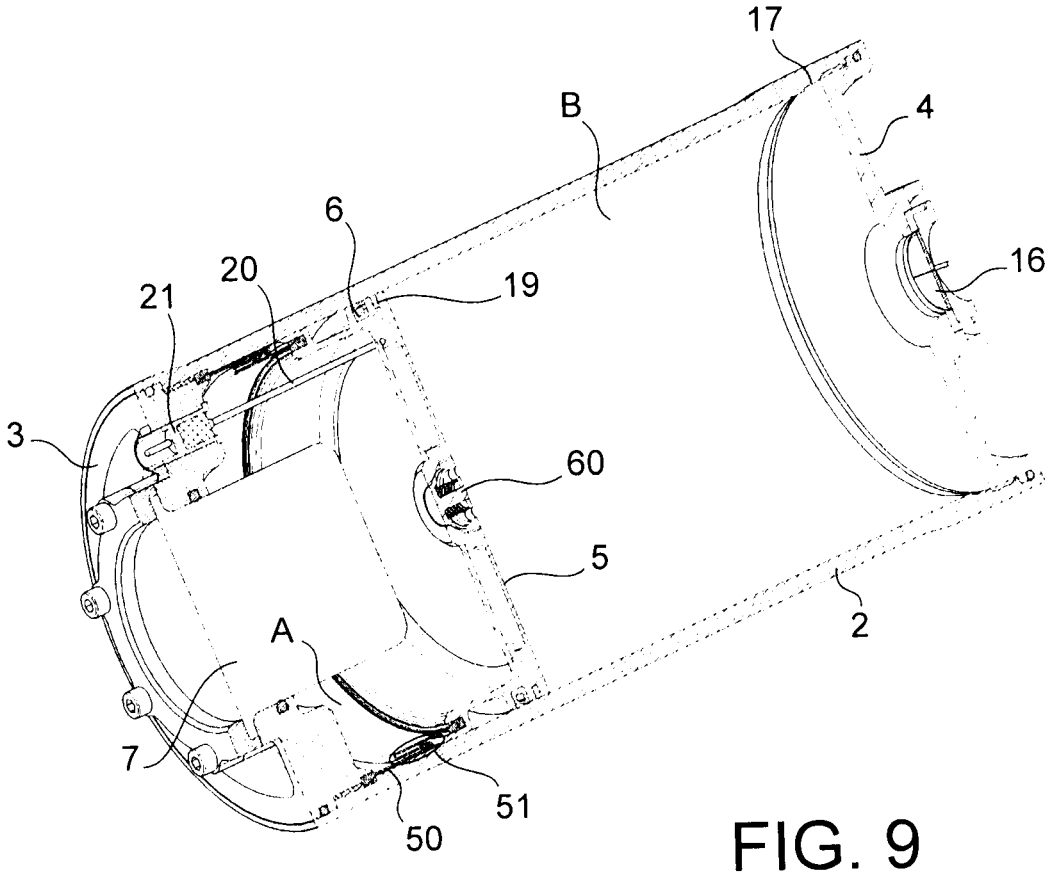
FIG. 9 is a global sectional view of the device according to one of the embodiments of the invention before its triggering, comprising a thimble.
Figure 10:
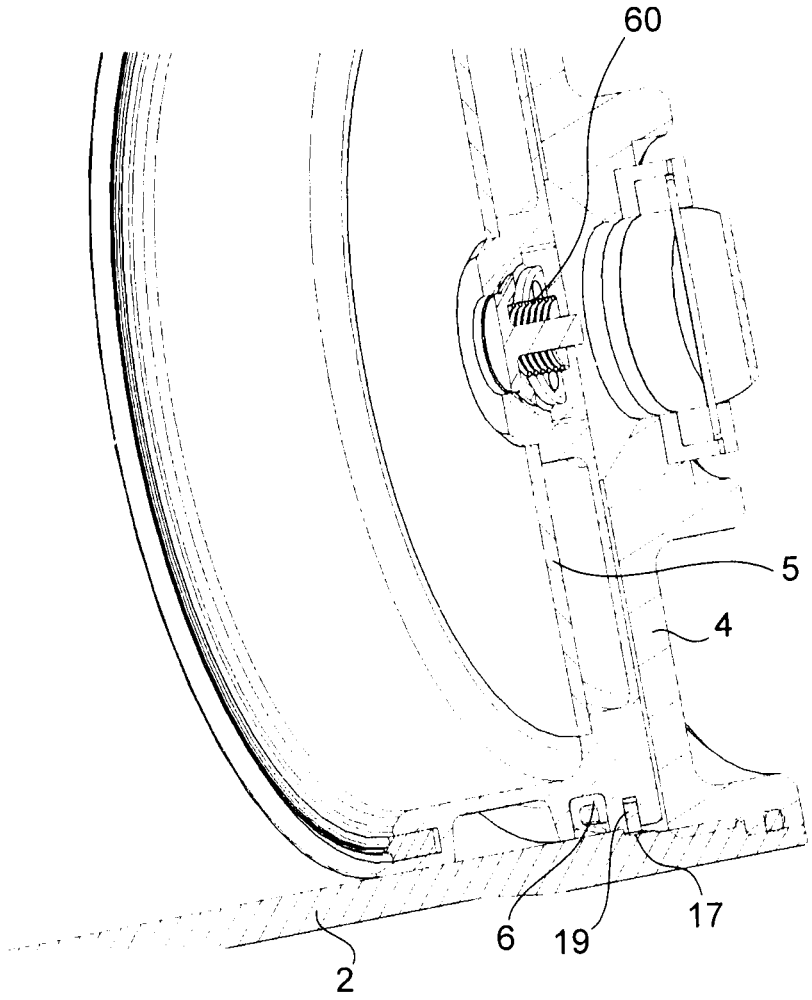
FIG. 10 is a detailed view of the device upon ending the discharge when the thimble is broken and the piston locked into position.

FIGS. 9 and 10 illustrate a second aspect of the invention.

The numerical references identical to those of FIGS. 2 and 3 designate identical or similar elements.

FIG. 9 illustrates the fluid ejection device according to an embodiment of the invention. The latter comprises a reservoir 1, the body 2 of which is of a substantially cylindrical shape, separated into two chambers A and B by a separating element 5 of the piston type, capable of longitudinally sliding in the reservoir. One of the chambers B contains the fluid to be ejected and is closed by an end portion 4 or flange, comprising a cap 16, separating the chamber B containing the fluid of the distribution circuit.

The piston 5 comprises sealing means with the inner side wall of the reservoir, in the form of an elastic segment 19 and/or a gasket with a lip 6, or a seal segment. The pressurization chamber A is also closed by another end portion 3, or flange, and contains a pyrotechnic gas generator 7. Advantageously the flange 3 closing the pressurization chamber is provided with means forming a valve (not shown) and with which the latter may be put into communication with the open air with regard to slow pressure changes.

Advantageously, the device includes a system for monitoring its integrity, for example as a ground circuit closed by a wire 20 with a determined length, as described earlier. The length of this wire enables it to follow the position changes of the piston over a given range. Such position changes are for example related to heat expansion of the fluid to be ejected. When the device has been triggered or when the level of fluid to be ejected reaches a defined minimum, because of an evaporation phenomenon due to a slight leak towards the outside for example, the wire 20 breaks, opening the ground circuit. It is therefore possible to monitor by a simple electric measurement, taken at the contact 21 located on the upper flange 3, in order to check the integrity of the system, i.e.:

that the ejection device has not been triggered;

that the volume of fluid to be ejected has not passed below a critical threshold which would not allow any longer the device to fully ensure its role of an extinguisher or of hydraulic backup.

As described earlier, the piston is maintained in contact with the fluid to be ejected by means forming a spring acting on the piston along the longitudinal axis of the cylinder. These spring-forming means may be formed with a coil spring with a longitudinal axis (not shown) positioned between the upper flange 3 and the piston 5, or, if the device does not have any means for exposing the pressurization chamber to the open air, they may be formed by the gas initially contained in the latter. According to this embodiment, the pressurization chamber A is sealed off relatively to the outside. Said gas, preferably an inert gas, is introduced therein upon mounting the device under a pressure slightly greater than atmospheric pressure via a valve (not shown) for example located on the upper flange 3. This initial gas pressure in the pressurization chamber is selected so that the piston presses on the fluid to be ejected even if said fluid occupies a minimum volume under the effect of heat expansion and when the maximum pressure in the fluid, when the latter occupies a maximum volume under the effect of heat expansion, is sufficiently far from the pressure causing breakage of the cap, so that there cannot be any risk of breaking the cap except for the triggering case of the device.

According to the invention, the seal between both chambers is improved by the presence of a thimble 50 comprised between the piston 5 and the upper flange 3 in the pressurization chamber A. Advantageously, this thimble consists of a diametrically expandable material, so that it may ensure its sealant role during the pressure rise in the pressurization chamber. In order that the thimble 50 does not prevent the piston from constantly pressing on the fluid to be ejected, the latter consists of a longitudinally extensible material between two extreme positions which the piston may occupy in contact with the fluid to be ejected under the effect of heat expansion of this fluid. According to an advantageous embodiment, the thimble 50 includes at least one fold 51 which facilitates extension thereof.

If an amount of ejection agent is trapped under the thimble 50 over time because of slow degradation of the seal of the gasket 6, this remnant will be pushed back through the seal gasket which is of the type adapted during the emptying phase. A lip gasket is perfectly adapted to this operation.

The combined effects of the rise in pressure in the pressurization chamber A and of the extension until its breaking of the thimble 50, press the thimble against the wall of the pressurization chamber thereby ejecting the fluid remnant through the gasket 6. If the whole agent remnant were not be totally pushed back through the gasket 6, the latter would however be ejected in the fifth phase of the emptying procedure.

The triggering of the discharge of the reservoir is performed by triggering the pyrotechnic gas generator 7. The generation of a gas volume in the pressurization chamber leads to pressure increase in this chamber, a pressure which is transmitted to the fluid to be ejected in the other chamber B via the piston. Under the effect of this pressure, the cap 16 breaks causing flow of the fluid into the distribution circuit and translational movement of the piston, pressed against the fluid by the pressure generated in the pressurization chamber.

The pressure in the pressurization chamber also causes diametrical expansion of the thimble 50.

The translational movement of the piston beyond a defined position causes breaking of the wire 20 and then breaking of the thimble.

At the end of travel, a shoulder 17 made on the wall of the chamber B containing the fluid in the vicinity of the end, allows expansion of the elastic segment 19 of the piston. The expansion of the segment blocks any possibility of upward movement of the piston, and therefore any possibility of upward movement of the fluid in the reservoir.

Advantageously, the piston comprises a valve 60 capable of letting through the gases from the pyrotechnic reaction towards the distribution circuit, in order to purge it.

FIGS. 11-19 illustrate a third aspect of the invention.

Numerical references identical to those of FIGS. 2 and 3 designate identical or similar elements.

Figure 11A:
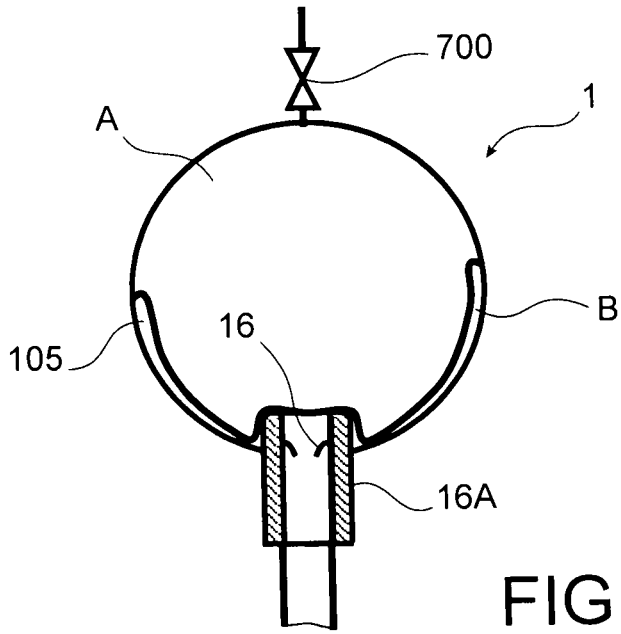
FIG. 11A is a sectional view of a device according to an embodiment of the invention using a spherical reservoir comprising a membrane separating the fluid from the pressurized gases injected into the reservoir in order to empty it. Said reservoir is illustrated upon ending the emptying, the membrane blocking the orifice for connection to the distribution circuit.

FIG. 11A illustrates a first embodiment of a fluid ejection device according to said third aspect of the invention using a reservoir 1 of a substantially spherical shape comprising an inner membrane 105 separating the reservoir into two chambers A, B. The first chamber A may be put into communication with a compressed gas via the valve 700. The second chamber B contains the fluid which should be ejected, such as an extinguishing agent for fire fighting.

When the pressurized gas fills the chamber A, the membrane 105 deforms towards the chamber B containing the fluid, the pressure increase which results from this in said fluid causes breakage of the tearable cap 16 freeing the orifice for connecting the reservoir to the fluid distribution circuit 25. Thus, the reservoir is put into communication with the distribution circuit 25 and the fluid is poured into the latter towards the point of use.

Figure 1:
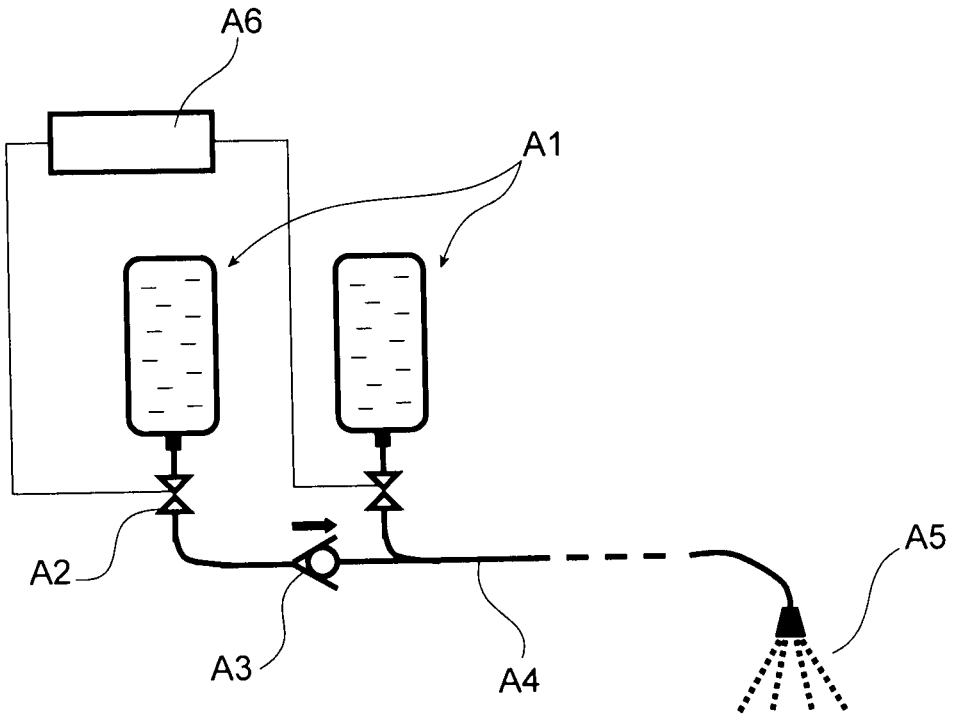

FIG. 11A illustrates such a device upon ending the emptying. The chamber B no longer contains any fluid or very little fluid. The membrane 105 is then flattened by the pressure against the communication orifice between the reservoir and the distribution circuit and blocks this orifice so that any reintroduction of fluid into the reservoir is impossible, and that several reservoirs of this type may be mounted in parallel on the same distribution circuit and sequentially triggered without having the ejected fluid from a reservoir filling one of the already emptied reservoirs. With equivalent functionalities relatively to the prior art (FIG. 1), with this embodiment it is possible suppress the anti-return valves on the circuit and thus suppress the reported pressure losses when they are present. Nevertheless, such a device has difficulties as to the selection of the membrane and to the prediction of its behavior and, subsequently, of the reliability of the device. Indeed, the membrane 105 may be sufficiently flexible in order to ensure complete emptying of the reservoir and efficient blocking of the connection orifice, also called ejection orifice, and sufficiently resistant in order not to be pierced under the effect of the pressure or of the encounter with the orifice upon ending the emptying. As an example, the membrane 105 may consist of a non-reinforced elastomer.

In order to improve the device as regards these drawbacks, an embodiment of the device according to the invention comprises (FIG. 2B) a reservoir 1, the body 2 of which is cylindrical, inside which a piston 5 is found comprising sealing means 6 between said piston and the inner wall of the reservoir. The piston is capable of moving axially in the reservoir, so as to cause ejection of the fluid out of the reservoir, in the fashion of a syringe. The displacement of the piston is obtained by any means known to one skilled in the art, notably via an actuator or by introducing pressurized gas into the reservoir on the side of the face opposite to the face of the piston in contact with the fluid.

Figure 11B:
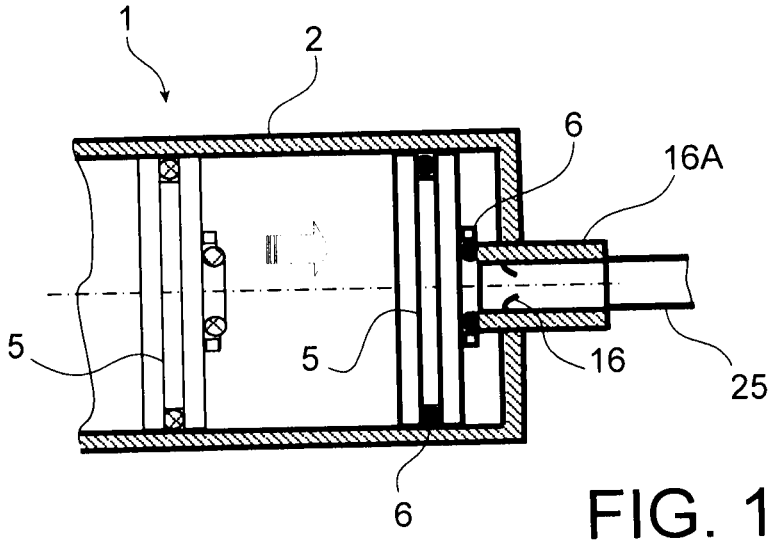
FIG. 11B is a sectional view of a device according to an embodiment of the invention using a cylindrical reservoir and ejecting the fluid by a piston moving axially in the reservoir.
Figure 12:
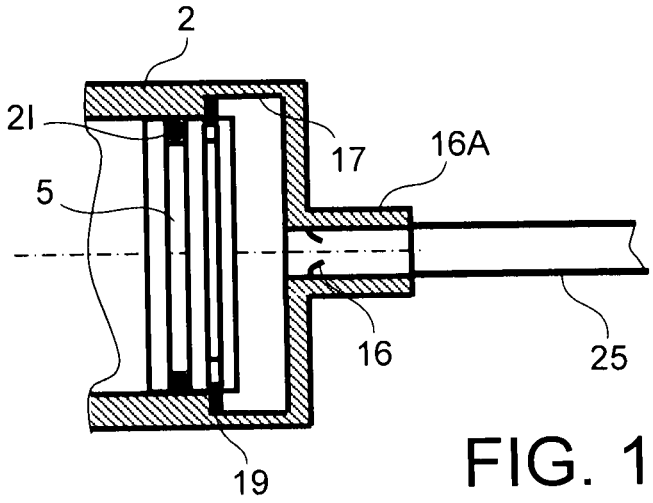
FIG. 12 illustrates a partial sectional view of the side of the orifice for connection to the distribution circuit having a device for locking the position of the piston at the end of travel.
Figure 13:
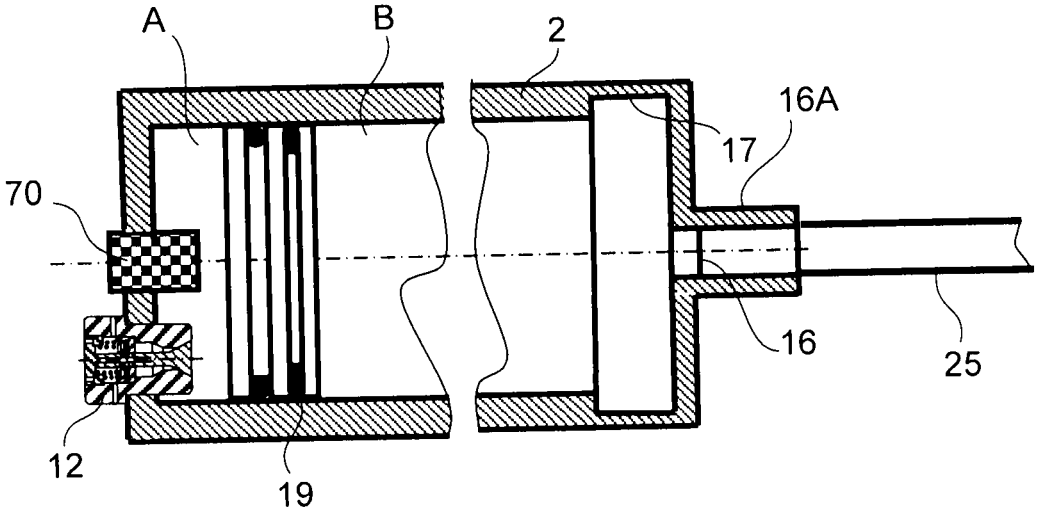
FIG. 13 illustrates a sectional view of the device according to an embodiment of the invention, wherein the triggering of the device is obtained by activating a pyrotechnic cartridge placed in the reservoir.

By causing the axial displacement of the piston 5 (FIG. 11B shows two steps for displacing said piston 5), the pressure in the fluid increases until it causes breakage of the tearable cap 16 blocking the orifice of the connection 16A of the reservoir with the distribution circuit 25. The fluid is ejected from the reservoir by displacing the piston 5 in the direction of the arrow and it then flows into the distribution circuit 25 towards the point of use. At the end of travel, the piston 5 will block the orifice for connection with the circuit, either by direct contact or via sealing means 6 which may be placed on the piston (case of FIG. 2B) or alternatively attached to the reservoir in proximity to the connection 16A with the distribution circuit.

As the orifice 16A of the connection with the distribution circuit is blocked by the piston, there cannot be any return of the fluid into the reservoir already emptied during the subsequent emptying of another reservoir mounted in parallel on the same distribution circuit 25. However, this solution like the previous one (FIG. 2A) imposes that the application force of the piston 5, or of the membrane 105, in the case of the embodiment according to FIG. 2A, on the periphery of the connection orifice, should be preserved, at least during the time for emptying the whole of the reservoirs. In the case when this application force is obtained by injecting a pressurized gas into the reservoir, this implies that the reservoir is maintained under pressure, which entails risks of explosion or of sudden depressurization of these reservoirs after its operation, notably upon reconfiguration of the latter following maintenance operations. Such sudden explosions or depressurizations may be very detrimental to the components located in proximity to these reservoirs.

In order to find a remedy to these drawbacks, an advantageous embodiment (FIG. 12) includes means for locking the piston 5 at the end of travel. These locking means may be obtained by the cooperation of an elastic ring 19 or elastic segment, installed in a groove of the piston 5 and of a shoulder 17 made in the reservoir body at the end including the connection with the distribution circuit 25.

By elastic reaction, the elastic segment or ring 19 placed in the groove of the piston tends to expand, i.e. to increase its diameter. When during its axial displacement in the reservoir in order to eject the fluid, the piston 5 arrives in the end-of-travel area, the elastic ring 19 moves apart until it reaches the diameter of the shoulder 17. Thus the piston can no longer return backward even in the absence of the application of a mechanical action on the latter.

Under these conditions, even if there is no perfect blocking of the connection with the circuit alone, a small amount of fluid issued from the emptying of another reservoir may penetrate into the emptied reservoir, the piston 5, locked in position by the locking means 17, 19, prevents any filling of the reservoir, via its sealing means with the inner wall of the reservoir 2I. Thus, after locking the piston, the volume of the reservoir placed behind the piston, may be purged so that it no longer contains any pressurized gas and thereby avoids any risk inherent to the presence of a pressurized element.

According to an advantageous embodiment (FIG. 13), the pressurized gas required for ejecting the fluid may be generated by triggering a pyrotechnic cartridge 70 directly placed in the reservoir or nearby. The piston then defines two chambers A, B separated in a sealed way, the first A being intended to receive the pressurized gas required for causing the axial displacement of the piston. The second chamber B contains the fluid.

Ignition of the pyrotechnic cartridge 70 causes generation of pressurized gas which has the effect of propelling the piston towards the other end, thereby compressing the fluid in the chamber B. When the fluid reaches a given pressure, it tears the cap and is poured into the distribution circuit. Upon ending the emptying, the piston is locked by the combined action of the elastic ring 19 and of the shoulder 17, thereby forming an anti-return element in the reservoir.

The reservoir may be equipped with a valve for balancing the pressures 12, for example as described earlier. This particular valve balances the pressure between the inside of the chamber A and the outside of the reservoir in the case of slow variation of said pressure and closes in the case of a pressure peak. Upon igniting the pyrotechnic gas generator 70 or upon introducing a pressurized gas, the sudden change in pressure which results from this in the chamber A closes the valve 12, and propels the piston 5 towards the other end of the reservoir, thereby ejecting the fluid after breakage of the cap 16. Upon ending the emptying, the elastic ring 19 moves apart in the shoulder 17 preventing any return of the piston and thereby forming an anti-return system with respect to the fluid in the distribution circuit. The pressure then stabilizes in the chamber A to a value greater than the pressure outside the body. The balancing valve 12 then allows the gas to escape out of the chamber A and the pressure to be lowered in the latter. Alternatively, the balancing valve 12 may normally be closed and controlled upon opening by a system connecting it to the position of the locked piston 5 at the end of travel, allowing depressurization of the chamber A.

According to this embodiment, a self-contained ejection device is made available which does not remain under pressure after its operation.

However, it is advantageous upon ending the emptying of the reservoir to direct the pressurized gases into the chamber A towards the distribution circuit so as to ensure total emptying of the distribution network.

Figure 14:
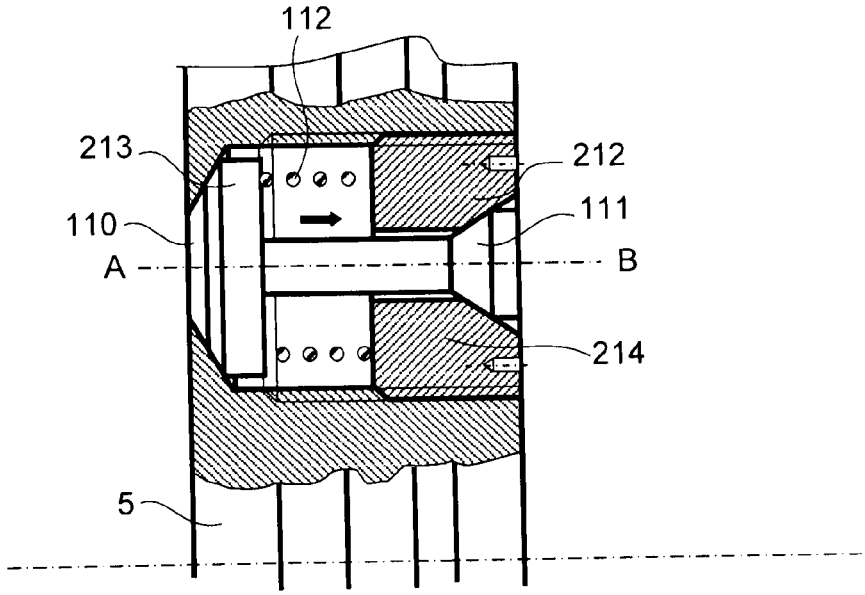
FIG. 14 is a partial sectional detailed view of a piston of the device according to an embodiment of the invention incorporating means with which the gases generated by the pyrotechnic device may be put into communication with the distribution circuit upon ending the emptying.
Figure 15:
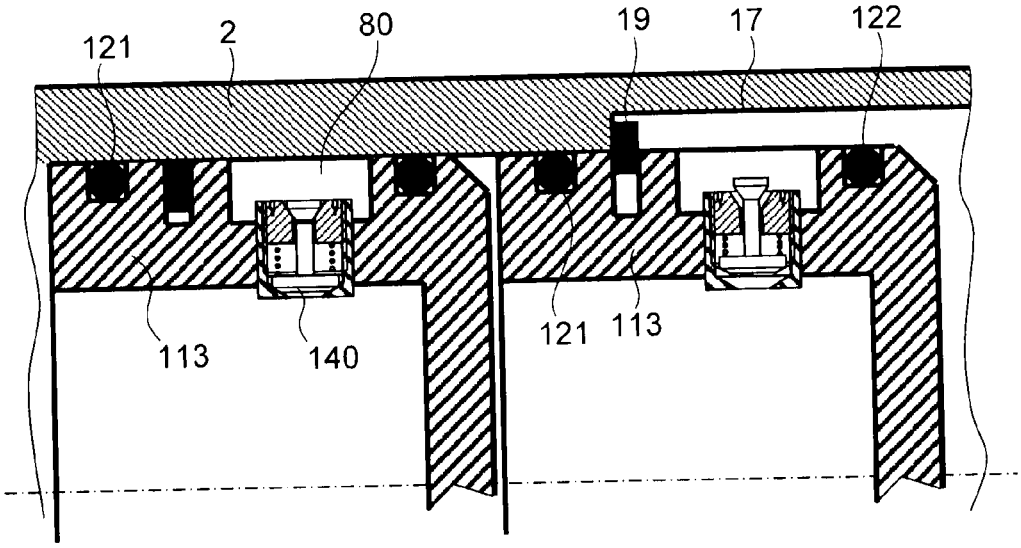
FIG. 15 shows a sectional view of a particular embodiment of the piston of the device according to the invention wherein said piston has a skirt and an annular area delimited by sealing means, said area comprises means with which the gases generated during the activation of the pyrotechnic device may be put into communication with the distribution circuit upon ending the emptying.
Figure 16:
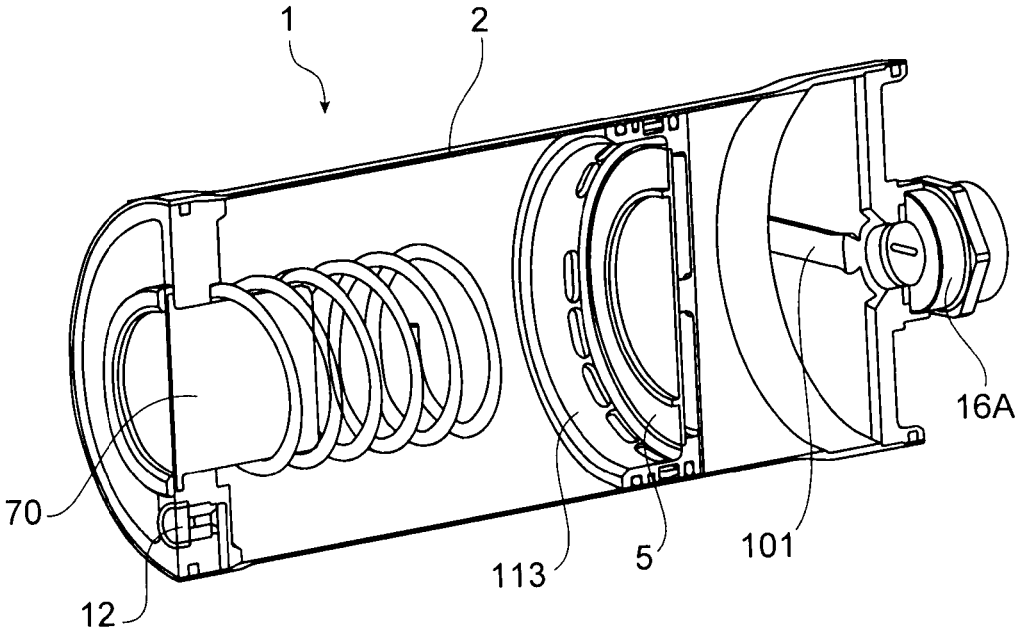
FIG. 16 shows a global sectional view of a device according to an embodiment of the invention equipped with a skirt piston with orifices and means capable of blocking these orifices in the form of an expandable ring.
Figure 17:
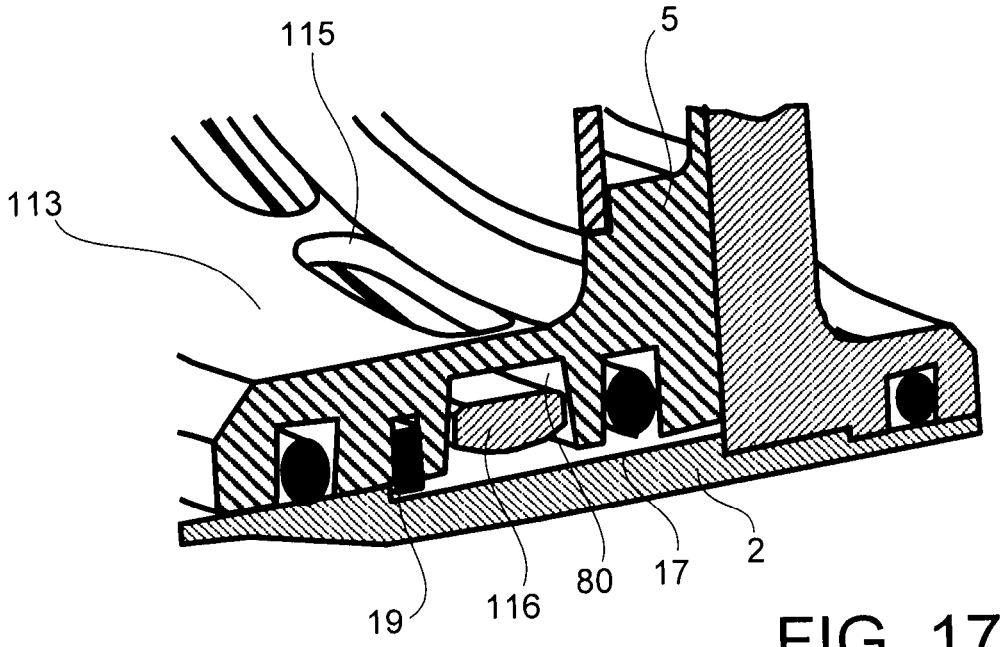
FIG. 17 is a detailed sectional view of the device according to FIG. 16 when the piston arrives at the end of travel and when the ring is expanded in order to let through the pressurized gases towards the distribution circuit.

FIG. 14 shows a partial sectional view of the piston 5 integrating means forming a valve capable of putting the chamber A containing the pressurized gas and the chamber B containing the fluid in communication. Such means forming a valve comprise a bore 110 in the piston 5, said bore is blocked by a valve 111 bearing upon two seats 212, 213, the seat 213 located on the side of the chamber A receiving the pressurized gas being directly made by the bore, the seat 212 located on the fluid side being formed in the added ring 214. The valve 111 is ideally pressed against each of the seats 212, 213 by spring-forming means 112.

According to an advantageous embodiment, the axial position of the ring 214 is adjustable in order to ensure perfect support of both ends of the valve 111 on the seats 212, 213. The spring-forming means 112 and the outer diameters of both ends of the valve 111 are selected so that during the emptying, the axial force applied on the valve resulting from the pressure of the gas and which tends to open said valve, is counterbalanced with the sum of the force applied on the other end of the valve by the fluid and of the force of the spring 112, the last two forces tending to close the valve. Thus, as long as there is fluid in the chamber B containing the fluid, the valve is closed and sealed.

When the reservoir is empty, the pressure applied by the gas on the valve 111 is no longer counterbalanced by the pressure of the fluid and the valve opens, letting through the pressurized gas which penetrates into the distribution circuit 25 and promotes ejection of the fluid.

When the pressure in the gas-containing chamber A drops, the valve 111 closes under the effect of the spring 112. As the valve is closed, the piston 5 is again sealed and plays its anti-return role with respect to the fluid contained in the distribution circuit 25.

Advantageously, the valve-forming means 140 (FIG. 14) may be positioned radially. According to this embodiment (FIG. 15), the piston 5 comprises a skirt 113 extending axially, said skirt including an annular groove comprised in sealing means 121, 122 positioned axially on either side of the groove. When the piston 5 provided with a skirt 113 is present in the reservoir, the sealing means 121, 122 and the groove form a sealed annular chamber 80.

Valve-forming means 140 are mounted radially and are capable of putting the annular chamber 80 in communication with the chamber A containing the pressurized gas.

During the emptying, both sealing means 121, 122 positioned on either side of the annular groove of the piston are in contact with the inner wall of the cylinder. The pressurized gas tends to open the valve 140, and enters the sealed annular chamber until the pressures counterbalance each other and the valve closes under the action of the spring of the valve.

At the end of travel of the piston, the elastic ring 19 expands in the shoulder 17 preventing the return of the piston 5. Because of the presence of the shoulder 17, the sealing means 122 located in proximity to the front face of the piston 5 is no longer in contact with the wall of the reservoir and no longer ensures its sealing function. Under the effect of the pressure of the gas, the valve 140 opens and puts the pressurized gas in communication with the distribution circuit 25.

According to an alternative embodiment (FIGS. 16 and 17), the valve-forming means in the skirt 113 of the piston are replaced with simple lumens 115 made in said skirt and opening into the sealed annular chamber 80. Said lumens are blocked by a circular elastic ring 116 placed in the groove of the piston and tending, by elasticity, to press against the bottom of this groove, so that the lumens of the skirt 115 are blocked by the ring 116. When the pressurized gas is introduced into the chamber A provided for this purpose, the pressure causes expansion of the ring 116 which no longer being pressed at the bottom of the groove puts the chamber A containing the pressurized gas in communication with the sealed annular chamber 80.

Advantageously, the bottom of the reservoir comprises abutment 101 capable of receiving the piston 5 at the end of travel. Upon ending the emptying, the piston will come into contact with said abutment 101 concurrently with the elastic ring 19 blocking the return of the piston by engaging into the shoulder 17. As part of the sealing means 122 is no longer in contact with the inner wall of the reservoir at the shoulder, the chamber 80 is no longer sealed at the end of travel. As the gas pressure continues to expand the ring 116, the gas may flow through the lumens 115 towards the distribution circuit. When the gas pressure drops, the ring 116 is necked down on the lumens again ensuring the seal of the piston and its role of anti-return system with respect to the fluid contained in the distribution circuit.

Figure 18:
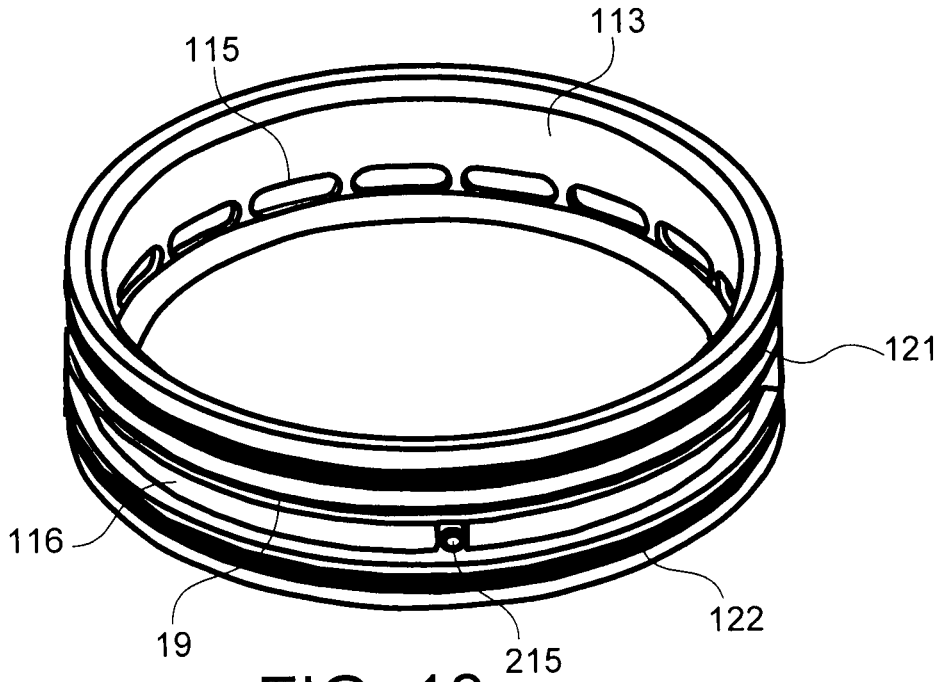
FIG. 18 is a view of the piston alone provided with the blocking elastic ring in the tightened position so that the latter blocks the lumens made in the skirt of the piston.
Figure 19:
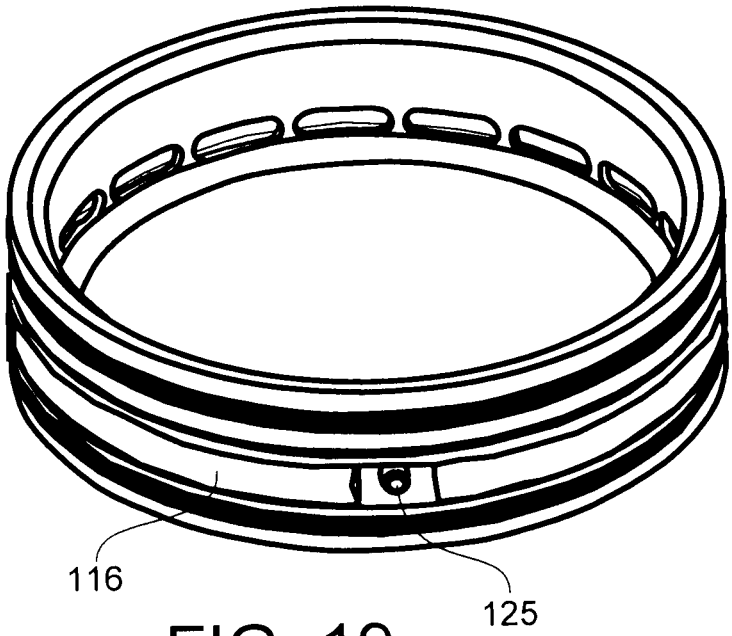
FIG. 19 illustrates the piston alone, the blocking elastic ring being in an expanded position, thereby allowing the pressurization gas to pass through towards the annular chamber.

The elastic ring 116 capable of blocking the lumens 115 advantageously appears as a slit ring (FIGS. 18 and 19). In addition to the fact of providing additional elastic expansion capacity, this slit may advantageously be used for angularly orienting the ring 116 and for ensuring that said slit is not positioned facing a lumen 115. For this purpose, the groove of the piston receiving the ring 116 is advantageously provided with a protrusion 215 at the bottom of the groove. When the blocking slit elastic ring 116 is mounted in the groove, both edges of the slit are positioned on either side of said protrusion 215. The cooperation between the slit and the protrusion 215 may thus stop the rotation of the ring 116 in the groove of the skirt of the piston.

The invention claimed is:

1. A device for ejecting a fluid comprising:

a reservoir of a substantially cylindrical shape having a first end and a second end opposite the first end, the reservoir having a shoulder on an inner surface of the reservoir near the second end of the reservoir;

a separating element dividing the reservoir into first and second chambers, the separating element including an expandable locking element in contact with the inner surface of the reservoir, the shoulder being configured to permit the expandable locking element to expand when the separating element has moved to a position where the expandable locking element has moved past the shoulder in a direction toward the second end of the reservoir, wherein the shoulder and the expandable locking element have mutually engaging shapes that lock the expandable locking element against movement in a direction toward the first end of the reservoir when the expandable locking element engages the shoulder after the separating element has moved to a position where the expandable locking element has moved past the shoulder in a direction toward the second end of the reservoir;

a seal provided between the separating element and side walls of the reservoir, the separating element configured to slide in the reservoir along a longitudinal axis of the reservoir and in contact with the inner surface of the reservoir from the first end to the shoulder, so as to change relative volume of the chambers, the first chamber being filled with a fluid and including an orifice closed by a cap so that the fluid may be ejected from the reservoir through the orifice under effect of translational movement of the separating element from the first end of the reservoir to the second end of the reservoir and an opening of the cap, wherein the shoulder is configured to increase the dimensions of the reservoir such that the seal does not contact the inner surface of the reservoir in a direction from the shoulder toward the second end of the reservoir, over a length of the reservoir sufficient that the second chamber can be depressurized when the separating element has moved to a position where the seal is located between the shoulder and the second end;

a fluid distribution circuit connected to said orifice;

a pyrotechnic gas generator in communication with the second chamber;

means for putting gases generated by a pyrotechnic reaction at the pyrotechnic gas generator in communication with the fluid distribution circuit upon ending ejection of the fluid; and means for modifying pressure in the second chamber, so as to cause a translational movement of the separating element, wherein the second chamber comprises a thimble configured to sealably separate an inside of the second chamber from the side walls of the reservoir, the thimble being broken beyond a defined longitudinal position of the separating element.

2. A device for ejecting a fluid comprising:

a reservoir of a substantially cylindrical shape;

a separating element dividing the reservoir into first and second chambers;

a seal provided between the separating element and side walls of the reservoir, the separating element configured to slide in the reservoir along a longitudinal axis of the reservoir so as to change relative volume of the chambers, the first chamber being filled with a fluid and including an orifice closed by a cap so that the fluid may be ejected from the reservoir through the orifice under effect of translational movement of the separating element and an opening of the cap;

a fluid distribution circuit connected to said orifice;

a pyrotechnic gas generator in communication with the second chamber;

means for putting gases generated by a pyrotechnic reaction at the pyrotechnic gas generator in communication with the fluid distribution circuit upon ending ejection of the fluid;

means for modifying pressure in the second chamber, so as to cause a translational movement of the separating element, wherein the second chamber comprises a thimble configured to sealably separate an inside of the second chamber from the side walls of the reservoir, the thimble being broken beyond a defined longitudinal position of the separating element; and a wire connected to the separating element, the wire being configured to break before the thimble breaks due to the translational movement of the separating element, the wire extending through a length of the second chamber from the separating element to an end of the reservoir forming a wall of the second chamber, wherein the second chamber includes a pressure control device configured to adopt an open configuration in an absence of the gases in the reservoir so as to ensure that said second chamber is exposed to open air of the outside environment regardless of the axial position of the separating element, and a closed configuration in a presence of the gases in the reservoir so as to provide the seal of said second chamber, said pressure control device including an open air exposing duct crossing a wall of said reservoir, a mobile part for closing said duct, the mobile part configured to be operated from a position for opening said duct, corresponding to the open configuration of the pressure control device, to a position of closing said duct, corresponding to the closed configuration of the pressure control device, and a spring configured so as to maintain the mobile part in its position for opening the duct as long as there is no gas generated by the pyrotechnic gas generator in the second chamber, and so as to allow the mobile part to move to its position for closing the duct under the effect of pressure of gas generated by the pyrotechnic gas generator in the second chamber.

3. The device according to claim 2, wherein the reservoir is of a substantially cylindrical shape having a first end and a second end opposite the first end, the reservoir having a shoulder on an inner surface of the reservoir near the second end of the reservoir, wherein the separating element includes an expandable locking element in contact with the inner surface of the reservoir, and wherein the expandable locking element expanding into the shoulder when the separating element moves to the second end such that the separating element is locked at the second end.

4. The fluid ejection device according to claim 2, wherein the thimble is further configured to ensure a seal between the second chamber and the walls of the cylinder in a constant way between two longitudinal positions of the separating element.

5. The device according to claim 4, wherein the thimble is made of a diametrically expandable flexible material.

6. The device according to claim 2, wherein the thimble includes at least one fold configured to unfold under effect of the translational movement of the separating element.

7. The device according to claim 2, further comprising means for preventing any return of gas or of fluid from the distribution circuit into the reservoir after complete discharge of the reservoir.

8. The device according to claim 2, wherein the fluid to be ejected is an extinguishing agent of the fluoroketone type.

9. The device according to claim 2, wherein the ejected fluid is hydraulic oil.

10. An aircraft comprising a device according to claim 7.

11. The device according to claim 2, further comprising:

a wire connected to the separating element, the wire being configured to break before the thimble breaks due to the translational movement of the separating element, the wire extending through a length of the second chamber from the separating element to an end of the reservoir forming a wall of the second chamber.

12. The device according to claim 11, further comprising:

a monitoring system connected to the wire and configured to determine if the device is operating properly based on whether or not the wire has broken.

13. The device according to claim 11, wherein the wire completes an electric circuit through a ground return running through a body of the reservoir.

* * * * *